US009107470B2

(12) United States Patent
Fallow et al.

(10) Patent No.: US 9,107,470 B2
(45) Date of Patent: Aug. 18, 2015

(54) ARTICLE OF FOOTWEAR FOR DANCING

(71) Applicant: Nike, Inc., Beaverton, OR (US)

(72) Inventors: Ann Marie Catherine Fallow, Portland, OR (US); Timothy S. Ferrigan, Banks, OR (US); Patricia J. Graser, Hillsboro, OR (US); Young Jin Kim, Busan (KR); Bradley S. Long, Portland, OR (US); Ann-Marie Paz, Portland, OR (US); Christine L. Saito, Boulder, CO (US); Helen Woo, Quincy, MA (US)

(73) Assignee: NIKE, Inc., Beaverton, OR (US)

( * ) Notice: Subject to any disclaimer, the term of this patent is extended or adjusted under 35 U.S.C. 154(b) by 314 days.

(21) Appl. No.: 13/664,683

(22) Filed: Oct. 31, 2012

(65) Prior Publication Data

US 2013/0118038 A1 May 16, 2013

Related U.S. Application Data

(62) Division of application No. 12/419,671, filed on Apr. 7, 2009, now Pat. No. 8,333,024.

(51) Int. Cl.

| | |
|---|---|
| ***A43B 13/14*** | (2006.01) |
| ***A43B 5/12*** | (2006.01) |
| ***A43B 3/00*** | (2006.01) |
| ***A43B 5/02*** | (2006.01) |
| ***A43B 13/16*** | (2006.01) |
| ***A43B 13/22*** | (2006.01) |

(52) U.S. Cl.

CPC ..... *A43B 5/12* (2013.01); *A43B 3/0042* (2013.01); *A43B 3/0052* (2013.01); *A43B 5/02* (2013.01); *A43B 13/141* (2013.01); *A43B 13/16* (2013.01); *A43B 13/223* (2013.01)

(58) Field of Classification Search

CPC .... A43B 13/223; A43B 13/141; A43B 13/16; A43B 3/0052; A43B 3/0042; A43B 5/12

See application file for complete search history.

(56) References Cited

U.S. PATENT DOCUMENTS

| | | | | |
|---|---|---|---|---|
| D39,747 | S | | 1/1909 | McKenna |
| D115,636 | S | * | 7/1939 | Sperry ..... D2/959 |
| 2,229,406 | A | * | 1/1941 | Cutler ..... 36/59 R |
| D201,952 | S | | 8/1965 | Johns |
| D234,930 | S | | 4/1975 | Arambasic |
| 4,096,649 | A | | 6/1978 | Saurwein |
| 4,128,951 | A | | 12/1978 | Tansill |
| 4,227,320 | A | | 10/1980 | Borgeas |
| D259,595 | S | | 6/1981 | Famolare, Jr. |
| 4,366,634 | A | | 1/1983 | Giese et al. |
| D275,146 | S | | 8/1984 | Kilgore |
| 4,494,320 | A | | 1/1985 | Davis |
| 4,519,148 | A | | 5/1985 | Sisco |
| 4,541,186 | A | | 9/1985 | Mulvihill |

(Continued)

FOREIGN PATENT DOCUMENTS

| | | |
|---|---|---|
| GB | 2221140 | 1/1990 |
| GB | 2425931 | 11/2006 |
| WO | 9404049 | 3/1994 |

*Primary Examiner* — Ted Kavanaugh

(74) *Attorney, Agent, or Firm* — Plumsea Law Group, LLC

(57) ABSTRACT

An article of footwear with a pivot portion including a plurality of flex grooves is disclosed. The plurality of flex grooves provides increased flexibility in different portions of a sole of the article. In addition, a periphery of the sole includes sole pods to increase the traction on the periphery of the sole.

20 Claims, 13 Drawing Sheets

(56) References Cited

U.S. PATENT DOCUMENTS

| | | | |
|---|---|---|---|
| 4,562,651 | A | 1/1986 | Frederick et al. |
| 4,571,852 | A | 2/1986 | Lamarche et al. |
| 4,653,206 | A | 3/1987 | Tanel |
| 4,676,011 | A | 6/1987 | O'Rourke et al. |
| D295,462 | S | 5/1988 | Brown et al. |
| D298,483 | S | 11/1988 | Liggett et al. |
| 4,890,398 | A | 1/1990 | Thomasson |
| 4,897,936 | A | 2/1990 | Fuerst |
| 5,012,597 | A | 5/1991 | Thomasson |
| 5,111,597 | A | 5/1992 | Hansen et al. |
| 5,131,173 | A | 7/1992 | Anderie |
| 5,203,097 | A | 4/1993 | Blair |
| 5,282,288 | A | 2/1994 | Henson |
| 5,313,718 | A | 5/1994 | McMahon et al. |
| 5,392,537 | A | 2/1995 | Goldberg |
| 5,410,821 | A | 5/1995 | Hilgendorf |
| D366,952 | S | 2/1996 | Pyle |
| D373,674 | S | 9/1996 | Dolinsky |
| 5,560,126 | A | 10/1996 | Meschan et al. |
| 5,669,161 | A | 9/1997 | Huang |
| 5,682,685 | A | 11/1997 | Terlizzi |
| D387,864 | S | 12/1997 | Hatfield |
| 5,740,618 | A | 4/1998 | Minden |
| D394,939 | S | 6/1998 | Avar |
| 5,761,832 | A | 6/1998 | George |
| D397,851 | S | 9/1998 | Greenberg |
| D400,344 | S | 11/1998 | Avar |
| 5,918,385 | A | 7/1999 | Sessa |
| D413,012 | S | 8/1999 | Challant |
| D415,339 | S | 10/1999 | Rombis |
| 5,970,631 | A | 10/1999 | Inman |
| 6,021,588 | A | 2/2000 | Alviso |
| 6,023,859 | A | 2/2000 | Burke et al. |
| 6,035,559 | A | 3/2000 | Freed et al. |
| 6,065,230 | A | 5/2000 | James |
| 6,076,283 | A | 6/2000 | Boie |
| 6,161,240 | A | 12/2000 | Huang |
| 6,266,897 | B1 | 7/2001 | Seydel et al. |
| 6,308,439 | B1 | 10/2001 | Ellis, III |
| 6,389,712 | B1 | 5/2002 | Schelling |
| D460,247 | S | 7/2002 | Liu et al. |
| 6,412,196 | B1 | 7/2002 | Gross |
| 6,470,600 | B1 | 10/2002 | Louie |
| 6,516,540 | B2 | 2/2003 | Seydel et al. |
| 6,516,541 | B2 | 2/2003 | Cagner |
| D476,143 | S | 6/2003 | McDowell |
| 6,574,889 | B2 | 6/2003 | Cagner |
| 6,578,290 | B1 | 6/2003 | Meynard |
| 6,609,312 | B1 | 8/2003 | Ellis, III |
| D480,202 | S | 10/2003 | Schroeder et al. |
| 6,634,121 | B2 | 10/2003 | Sordi |
| D489,880 | S | 5/2004 | McClaskie |
| 6,748,674 | B2 | 6/2004 | Ellis, III |
| D493,027 | S | 7/2004 | Heil |
| 6,789,332 | B1 | 9/2004 | Scholz |
| 6,836,978 | B1 | 1/2005 | Lauer et al. |
| 6,865,825 | B2 | 3/2005 | Bailey, Sr. et al. |
| 6,883,253 | B2 | 4/2005 | Smith et al. |
| D504,555 | S | 5/2005 | Urie |
| D504,998 | S | 5/2005 | McClaskie |
| 6,895,693 | B2 | 5/2005 | Baruck |
| 6,920,705 | B2 | 7/2005 | Lucas et al. |
| 6,931,768 | B2 | 8/2005 | Baek |
| D512,212 | S | 12/2005 | Hatfield |
| D512,826 | S | 12/2005 | Hatfield |
| 7,020,988 | B1 | 4/2006 | Holden et al. |
| 7,168,190 | B1 | 1/2007 | Gillespie |
| 7,191,550 | B2 | 3/2007 | Baek |
| D540,013 | S | 4/2007 | Issler |
| D540,015 | S | 4/2007 | McClaskie |
| 7,225,564 | B1 | 6/2007 | Gillespie |
| D551,833 | S | 10/2007 | Feller |
| 7,278,226 | B2 | 10/2007 | Holden et al. |
| D555,887 | S | 11/2007 | Link |
| 7,334,354 | B2 | 2/2008 | Foxen et al. |
| D564,735 | S | 3/2008 | McClaskie |
| D569,593 | S | 5/2008 | Avar |
| 7,377,055 | B2 | 5/2008 | Bramani |
| D573,333 | S | 7/2008 | Petrie |
| D573,334 | S | 7/2008 | Petrie |
| 7,392,604 | B2 | 7/2008 | Greene et al. |
| 7,430,817 | B2 | 10/2008 | Abadjian et al. |
| 7,607,241 | B2 * | 10/2009 | McDonald et al. ..... 36/102 |
| 7,774,957 | B2 | 8/2010 | Shepherd |
| 2002/0043008 | A1 | 4/2002 | Favreau |
| 2002/0078591 | A1 | 6/2002 | Morrone |
| 2002/0166262 | A1 | 11/2002 | Hernandez |
| 2003/0056394 | A1 | 3/2003 | Yu |
| 2003/0201563 | A1 | 10/2003 | Umezawa |
| 2005/0183286 | A1 | 8/2005 | Crary |
| 2005/0229431 | A1 | 10/2005 | Gerlin |
| 2006/0010718 | A1 | 1/2006 | Auger et al. |
| 2006/0143944 | A1 | 7/2006 | Collins |
| 2006/0156581 | A1 | 7/2006 | Holden et al. |
| 2006/0288611 | A1 | 12/2006 | Hogan |
| 2007/0107264 | A1 | 5/2007 | Meschter et al. |
| 2007/0107265 | A1 | 5/2007 | Mueller et al. |
| 2007/0199208 | A1 | 8/2007 | Wilkenfeld |
| 2007/0227039 | A1 | 10/2007 | Chaney et al. |
| 2007/0227045 | A1 | 10/2007 | Aveni et al. |
| 2007/0277394 | A1 | 12/2007 | Hansen et al. |
| 2008/0000108 | A1 | 1/2008 | Ellis, III |
| 2008/0010854 | A1 | 1/2008 | Sokolowski |
| 2008/0034613 | A1 | 2/2008 | Wilkenfeld et al. |
| 2008/0141562 | A1 | 6/2008 | Peveto |
| 2008/0168681 | A1 | 7/2008 | Andersen et al. |
| 2009/0293314 | A1 * | 12/2009 | Dekovic et al. ..... 36/103 |
| 2010/0107448 | A1 | 5/2010 | Fallow et al. |

* cited by examiner

ARTICLE OF FOOTWEAR FOR DANCING

CROSS-REFERENCE TO RELATED APPLICATION

This application is a divisional of U.S. Patent Publication Number 2010/0107448, entitled "Article of Footwear for Dancing," and published on May 6, 2012, which application claims priority under 35 U.S.C. §119(e) to U.S. Provisional Patent Application No. 61/103,922, entitled "Article of Footwear for Dancing", and filed on Oct. 8, 2008, both applications are hereby incorporated by reference.

BACKGROUND

The present invention relates to an article of footwear, and in particular, to an article of footwear with flex grooves.

Articles of footwear configured for pivoting have been previously proposed. These articles typically include a pivot disposed on a ball portion of a foot. In addition, the periphery of a sole surrounding the pivot does not contact the ground in a uniform manner, which can lead to instability of the foot.

There is a need in the art for a design that overcomes these shortcomings.

SUMMARY

The invention discloses an article of footwear for dancing. In one aspect, the invention provides an article of footwear, comprising: a sole including a central portion and a peripheral portion disposed outwards from the central portion; a pivot portion disposed on the central portion; a plurality of flex grooves extending in a radial direction from the pivot portion, at least one flex groove of the plurality of flex grooves extending through the central portion and the peripheral portion; and where the plurality of flex grooves is configured to facilitate bending of the central portion and the peripheral portion.

In another aspect, the plurality of flex grooves includes a first flex groove set including four flex grooves that are arranged in a cross-hair like pattern around the pivot portion.

In another aspect, a longitudinal flex groove of the first flex groove set extends from the pivot portion to a heel portion of the sole.

In another aspect, the longitudinal flex groove extends over a substantial majority of the length of the sole and wherein the location of the longitudinal flex groove corresponds to a centerline of the sole.

In another aspect, the plurality of flex grooves includes a second flex groove set including four flex grooves associated with the peripheral portion of the sole and wherein each of the flex grooves from the second flex groove set is disposed between two adjacent flex grooves from the first flex groove set.

In another aspect, the sole includes a plurality of sole pods and wherein the plurality of sole pods are disposed on the peripheral portion of the sole.

In another aspect, the plurality of sole pods includes a first sole pod, a second sole pod and a third sole pod, disposed on a toe portion, lateral portion and a medial portion of the peripheral portion, respectively.

In another aspect, the first sole pod and the third sole pod are separated by a second flex groove of the first flex groove set and wherein the second sole pod and the third sole pod are separated by a third flex groove of the second flex groove set.

In another aspect, the pivot portion has a first coefficient of friction that is substantially less than a second coefficient of friction of the plurality of sole pods.

In another aspect, the invention provides an article of footwear, comprising: a sole including a central portion and a peripheral portion disposed outwards from the central portion; a pivot portion disposed on the central portion; a plurality of sole pods disposed on the peripheral portion, the plurality of sole pods partially surrounding the pivot portion; the pivot portion having a first coefficient of friction and the plurality of sole pods having a second coefficient of friction; and where the first coefficient of friction is substantially less than the second coefficient of friction.

In another aspect, the plurality of sole pods includes at least three sole pods including a first sole pod, a second sole pod and a third sole pod disposed on a lateral portion, medial portion and toe portion of the peripheral portion, respectively.

In another aspect, the plurality of sole pods provide substantially continuous traction on the peripheral portion in a forefoot portion of the sole.

In another aspect, the plurality of sole pods includes a heel sole pod disposed on the peripheral portion in a heel portion of the sole and wherein the heel sole pod provides substantially continuous traction on the peripheral portion in the heel portion.

In another aspect, the sole includes a plurality of flex grooves configured to facilitate flexibility of the sole and wherein the plurality of flex grooves extends in a substantially radial direction from the pivot portion.

In another aspect, at least one of the flex grooves of the plurality of flex grooves extends through at least one sole pod of the plurality of sole pods.

In another aspect, at least two adjacent sole pods of the plurality of sole pods are separated by at least one flex groove from the plurality of flex grooves.

In another aspect, the invention provides an article of footwear, comprising: a sole including a forefoot portion, a heel portion and an arch portion disposed between the forefoot portion and the heel portion; a first flex groove set associated with the forefoot portion; a second flex groove set associated with the arch portion; and where first flex groove set is associated with a first average depth that is substantially less than a second average depth of the second flex groove set.

In another aspect, the first flex groove set includes a plurality of flex grooves extending in a substantially radial direction from a pivot portion of the forefoot portion.

In another aspect, the second flex groove set is configured to facilitate bending in a first bending direction associated with an upward bending of a toe portion of the sole and wherein the second flex groove set is configured to substantially reduce bending in a second bending direction associated with a downward bending of the toe portion.

In another aspect, the second flex groove set comprises four flex grooves and wherein the four flex grooves are arranged in a substantially x-like pattern.

Other systems, methods, features and advantages of the invention will be, or will become apparent to one with skill in the art upon examination of the following figures and detailed description. It is intended that all such additional systems, methods, features and advantages included within this description, be within the scope of the invention, and be protected by the following claims.

BRIEF DESCRIPTION OF THE DRAWINGS

The invention can be better understood with reference to the following drawings and descriptions. The components in the figures are not necessarily to scale, emphasis instead being placed upon illustrating the principles of the invention.

Moreover, in the figures, like reference numerals designate corresponding parts throughout the different views.

DETAILED DESCRIPTION OF THE ONE EMBODIMENT

Figure 1:
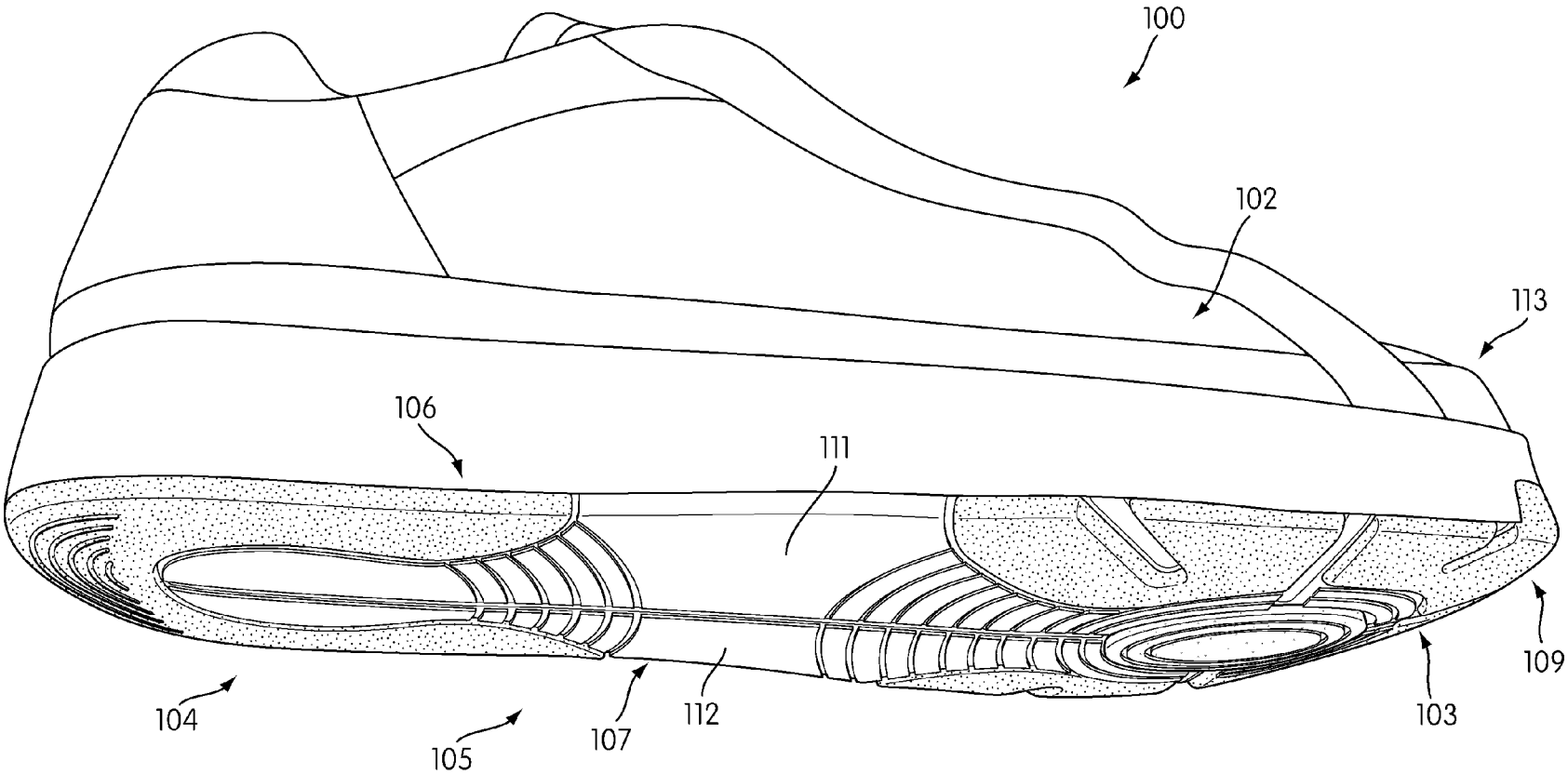
FIG. 1 is an isometric view of an embodiment of an article of footwear.
Figure 2:
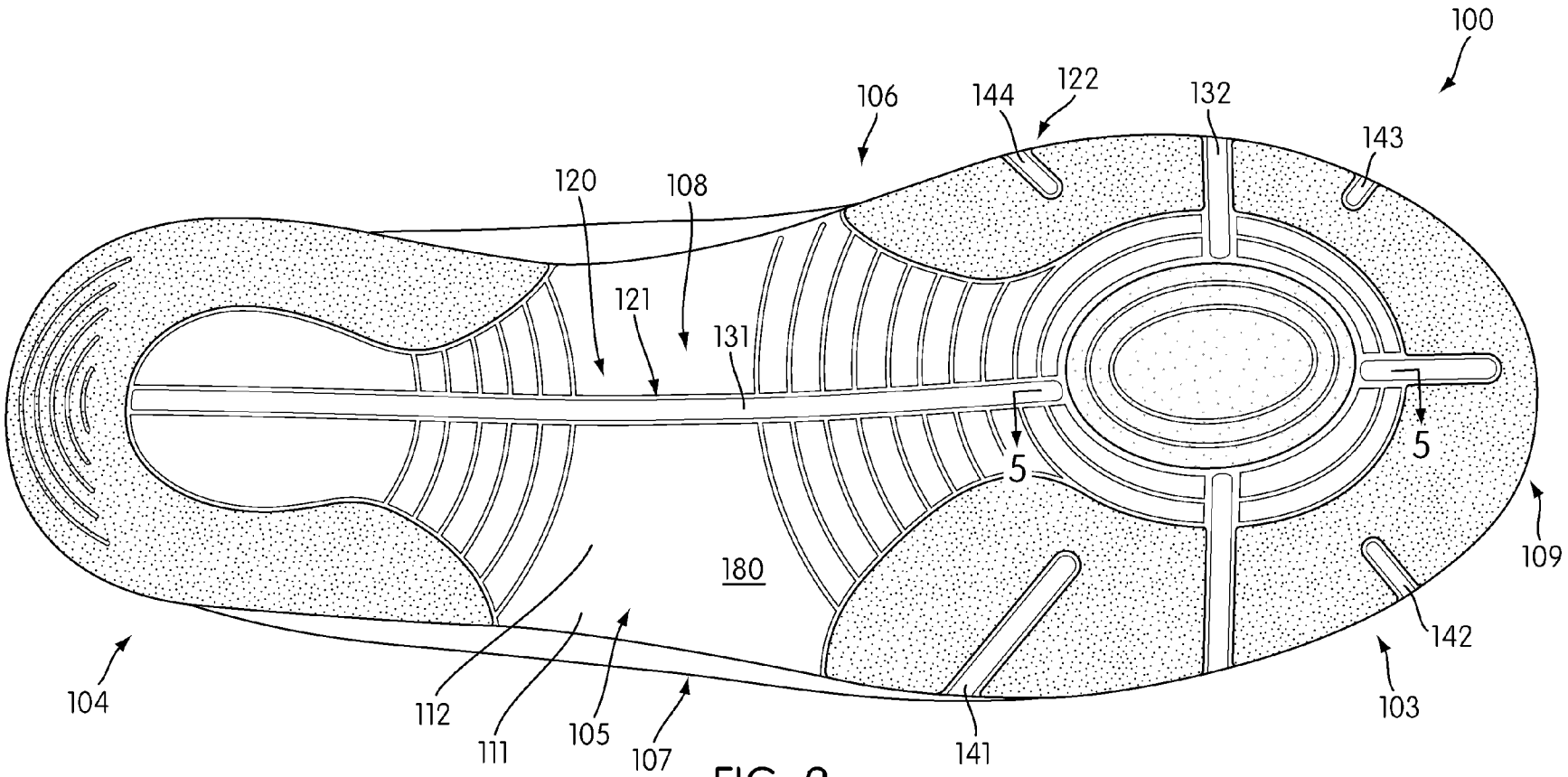
FIG. 2 is a bottom view of an embodiment of an article of footwear.

FIGS. 1 and 2 illustrate an embodiment of article of footwear 100. In particular, FIG. 1 is an isometric view of an embodiment of article of footwear 100 and FIG. 2 is a bottom view of an embodiment of article of footwear 100. For clarity, the following detailed description discusses an embodiment of article of footwear 100, in the form of a dance shoe, but it should be noted that the present invention could take the form of any article of footwear including, but not limited to: sneakers, soccer shoes, football shoes, rugby shoes, baseball shoes as well as other kinds of shoes. In some cases, article of footwear 100 may be used for hip-hop style dancing. However, in other cases, article of footwear 100 may be associated with other dancing styles.

As shown in FIGS. 1 and 2, article of footwear 100, also referred to simply as article 100, is intended to be used with a left foot. However, it should be understood that the following discussion may equally apply to a mirror image of article of footwear 100 that is intended for use with a right foot.

Article of footwear 100 includes upper 102. Generally, upper 102 may be any type of upper configured to receive a foot of a wearer. In particular, upper 102 could have any design, shape, size and/or color. For example, in embodiments where upper 102 is associated with a dance shoe configured for ballet dancing, upper 102 could be a soft bootie that is configured to enable flexing and movement of a foot. In other embodiments, however, upper 102 may comprise a stiffer structure to support a foot.

In some embodiments, article of footwear 100 may include a fastening system configured to tighten upper 102. Generally, article of footwear 100 could be associated with any type of fastening system including, but not limited to: laces, straps, zippers, hook and loop fasteners, as well as other types of fastening systems. For example, in one embodiment, article of footwear 100 may include a lacing system to tighten upper 102 around a foot.

For purposes of clarity, only some portions of upper 102 are discussed in this detailed description. However, it should be understood that upper 102 may include various features known in the art. For example, in embodiments where article 100 is a dance shoe, toe portion 113 of upper 102 may be configured with provisions for allowing a wearer to rise on toe portion 113 in an en pointe position. For example, in some cases, toe portion 113 may be associated with provisions including, but not limited to: pads, a toe bumper and other provisions.

Article of footwear 100 can include sole 105. Generally, sole 105 can include multiple components, including, but not limited to: an outsole, a midsole and an insole. In one embodiment, sole 105 includes an outsole, a midsole and an insole, not visible for illustrative purposes.

In addition, sole 105 includes bottom surface 180. Bottom surface 180 is configured to contact a ground surface. In some embodiments, bottom surface 180 may comprise an uneven surface. In an exemplary embodiment, bottom surface 180 may comprise a substantially flat surface of sole 105.

Sole 105 further comprises forefoot portion 103 and heel portion 104. Forefoot portion 103 may be associated with a forefoot of a foot. Furthermore, forefoot portion 103 can also comprise toe portion 109 that can be associated with toes of a foot. In addition, sole 105 also includes heel portion 104. Heel portion 104 may be associated with a heel of a foot. Likewise, sole 105 includes arch portion 108 disposed between forefoot portion 103 and heel portion 104. Arch portion 108 may be associated with an arch of a foot.

Sole 105 also includes central portion 112. Central portion 112 may be associated with a central portion of a foot. Furthermore, sole 105 includes peripheral portion 111. Peripheral portion 111 is disposed outwards from central portion 112. In particular, peripheral portion 111 extends around a periphery of bottom surface 180 of sole 105. Sole 105 also includes medial portion 106. Medial portion 106 may be associated with an inside of a foot. In addition, sole 105 includes lateral portion 107, disposed opposite of medial portion 106.

A sole of an article of footwear can include provisions for increasing the flexibility in different portions of the sole, including a forefoot portion. By increasing the flexibility in different portions of the sole, portions of the sole can flex and/or bend with respect to each other. In some embodiments, a sole can include provisions for providing a high degree of flexibility on a particular portion of a sole. In some cases, for example, a sole can include provisions for increasing flexibility of a forefoot portion in multiple directions relative to an arch portion or a heel portion.

In different embodiments, increased flexibility in a portion of a sole can be achieved in different ways. In some embodiments, a sole can comprise a flexible material to allow different portions of the sole to flex and/or bend with respect to each other. In an exemplary embodiment, a sole can include a plurality of flex grooves that allow different portions of the sole to flex and/or bend with respect to one another.

Flex grooves may be formed in any manner known in the art. In some embodiments, flex grooves may be formed by removing at least a portion of a sole. In some cases, flex grooves may be filled with a more flexible material than a sole. In other cases, flex grooves may remain hollow. This arrangement can allow flex grooves to compress when a wearer flexes and/or bends a sole. With this arrangement, flex grooves can facilitate the flexing and/or bending of a sole. By disposing flex grooves in different portions of a sole, portions of a sole can flex and/or bend with respect to one another.

In different embodiments, a plurality of flex grooves may be arranged in any manner on portions of sole 105 to facilitate the flexibility of sole 105. In some embodiments, a plurality of flex grooves may extend in a longitudinal direction on a sole. The term "longitudinal direction" as used throughout this detailed description and in the claims refers to a direction running between a toe portion and a heel portion of a sole. In other embodiments, a plurality of flex grooves can extend in a lateral direction on a sole. The term "lateral direction" as used throughout this detailed description and in the claims refers to a direction that is perpendicular to the longitudinal direction. In other words, the lateral direction may run between sides of a sole. In still other embodiments, a plurality of flex grooves can extend in a radial direction from a central portion of a sole. In some cases, at least one flex groove of the plurality of flex grooves can extend through the central portion and a peripheral portion of the sole.

Figure 3:
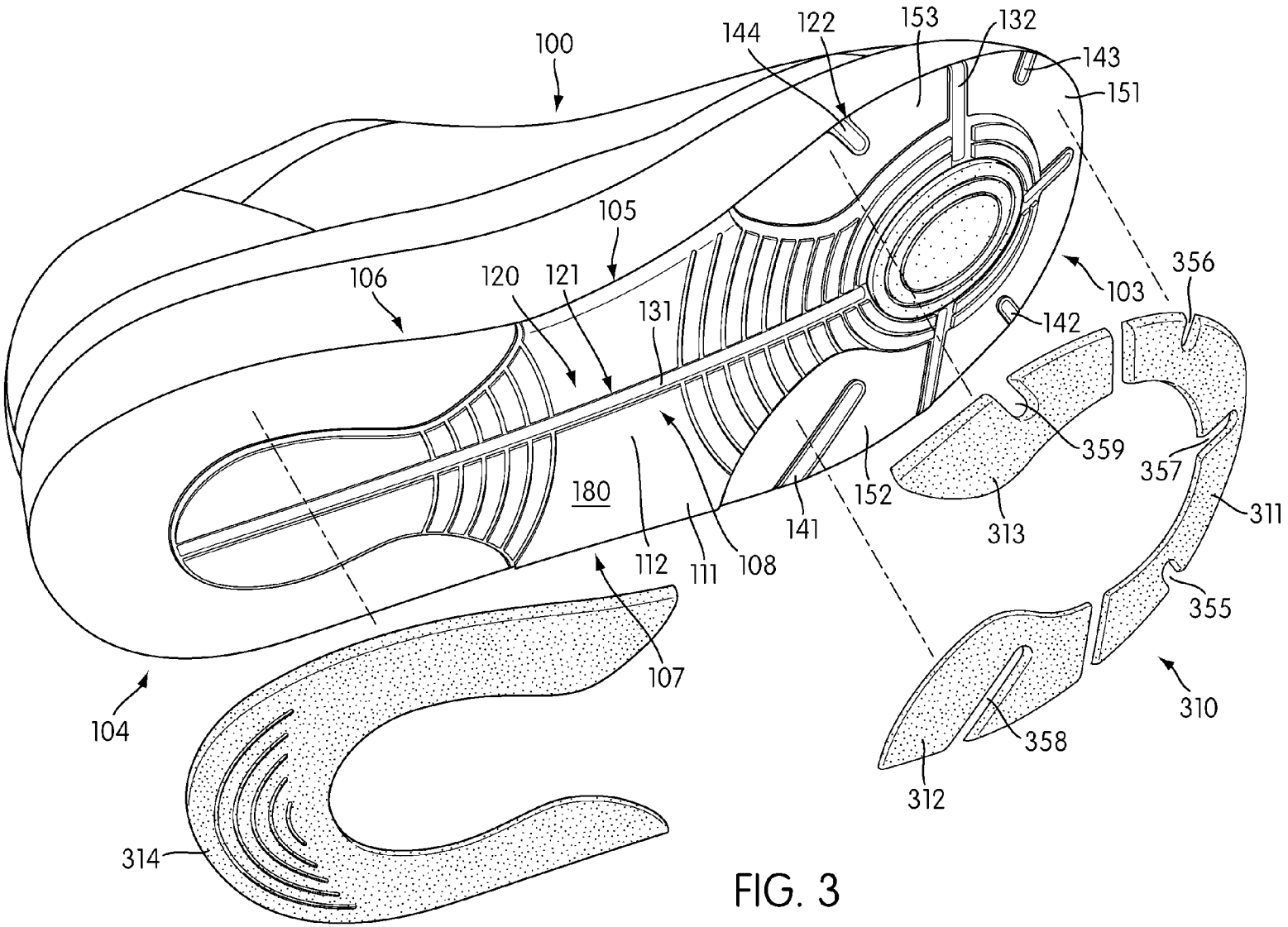
FIG. 3 is a exploded isometric view of an embodiment of an article of footwear.

FIG. 3 illustrates an isometric exploded view of an exemplary embodiment of sole 105 of article 100. Referring to FIGS. 2 and 3, sole 105 includes plurality of flex grooves 120. Plurality of flex grooves 120 includes first flex groove set 121. Furthermore, first flex groove set 121 includes longitudinal flex groove 131. Longitudinal flex groove 131 may correspond to a centerline of sole 105. In some embodiments, longitudinal flex groove 131 extends from toe portion 109 to heel portion 104. In some cases, longitudinal flex groove 131 may continuously extend from toe portion 109 to heel portion 104. In other cases, longitudinal flex groove 131 may be discontinuous as longitudinal flex groove 131 extends from toe portion 109 to heel portion 104. For example, longitudinal flex groove 131 may include a first portion that extends between central portion 112 of forefoot portion 103 to toe portion 109. Likewise, longitudinal flex groove 131 may include a second portion that extends from central portion 112 of forefoot portion 103 to heel portion 104. In other embodiments, longitudinal flex groove 131 extends from central portion 112 of forefoot portion 103 to heel portion 104. In one embodiment, longitudinal flex groove 131 extends over a substantial majority of the length of sole 105.

First flex groove set 121 may also include lateral flex groove 132. In some embodiments, lateral flex groove 132 extends in a substantially lateral direction across forefoot portion 103 of sole 105. In other words, lateral flex groove 132 extends between lateral portion 107 and medial portion 106 of forefoot portion 103. However, in other embodiments, lateral flex groove 132 may extend across another portion of sole 105, including, but not limited to: arch portion 108 or heel portion 104. In some cases, lateral flex groove 132 may continuously extend between lateral portion 107 and medial portion 106. In other cases, lateral flex groove 132 may be discontinuous as lateral flex groove 132 extends between lateral portion 107 and medial portion 106. For example, lateral flex groove 132 may include a first portion that extends from central portion 112 to lateral portion 107. Also, lateral flex groove 132 can include a second portion that extends between central portion 112 to medial portion 106. With this arrangement, lateral flex groove 132 extends through central portion 112 and peripheral portion 111.

In one embodiment, first flex groove set 121 may be arranged in a cross-hair like pattern on sole 105. In some cases, the cross-hair like pattern formed by first flex groove set 121 may be disposed on central portion 112 of forefoot portion 103. With this arrangement, longitudinal flex groove 131 and lateral flex groove 132 of first flex groove set 121 may extend in a radial direction from central portion 112 of forefoot portion 103.

In embodiments that include longitudinal flex groove 131 and lateral flex groove 132, forefoot portion 103 can also comprise first portion 151, second portion 152 and third portion 153. In particular, first portion 151 may be separated from second portion 152 and third portion 153 by lateral flex groove 132. Furthermore, second portion 152 and third portion 153 may be separated from each other by longitudinal flex groove 131. In some cases, first portion 151 may be associated with toe portion 109 of sole 105. In a similar manner, second portion 152 may be associated with lateral portion 107 of forefoot portion 103. Likewise, third portion 153 can be associated with medial portion 106 of forefoot portion 103. With this configuration, longitudinal flex groove 131 and lateral flex groove 132 may facilitate the bending and/or flexing of first portion 151, second portion 152 and third portion 153 with respect to each other.

In some embodiments, plurality of flex grooves 120 also includes second flex groove set 122. In some cases, second flex groove set 122 may be associated with peripheral portion 111 of forefoot portion 103. Furthermore, second flex groove set 122 extends in a diagonal direction that is between a lateral direction and a longitudinal direction. With this configuration, second flex groove set 122 extends in a radial direction from central portion 112 within forefoot portion 103.

Generally, second flex groove set 122 can include any number of flex grooves. In one embodiment, second flex groove set 122 includes four flex grooves. In particular, second flex groove set 122 includes first flex groove 141, second flex groove 142, third flex groove 143 and fourth flex groove 144.

In the current embodiment, first flex groove 141 is disposed within second portion 152 of forefoot portion 103. In a similar manner, second flex groove 142 and third flex groove 143 are disposed within first portion 151 of forefoot portion 103. Likewise, fourth flex groove 144 is disposed within third portion 153 of forefoot portion 103. This arrangement of flex grooves of second flex groove set 122 enhances the flexing and/or bending of different portions of forefoot portion 103 with respect to one another. Furthermore, each of the flex grooves of second flex groove set 122 is disposed between two adjacent flex grooves of first flex groove set 121. With this arrangement, flex grooves of both first flex groove set 121 and second flex groove set 122 can facilitate the bending of central portion 112 and peripheral portion 111 to assist with various dance moves. In particular, using flex grooves provides a high degree of multi-directional flexibility in the forefoot portion of the sole. In some cases, this arrangement allows a forefoot portion to flex in substantially any direction. Furthermore, this arrangement may allow for increased flexibility of the forefoot portion over the arch portion and the heel portion of the sole.

A sole of an article of footwear can include provisions to increase traction with a ground surface. Examples of ground surfaces include, but are not limited to: natural or synthetic grass, residential or commercial flooring, concrete, asphalt, as well as other types of surfaces. Generally, any portion of a sole can include provisions to increase traction. For example, in some embodiments, a central portion of a sole may include provisions to increase traction with a ground surface. In other embodiments, a central portion and a peripheral portion of a sole may include provisions to increase traction with a ground surface. In still other embodiments, a peripheral portion of a sole may include provisions to increase traction with a ground surface.

In some cases, a sole may include traction elements and/or cleats to increase traction. In other cases, a sole may include a textured surface to increase traction. In still other cases, a sole may include sole pods to increase traction with a ground surface.

Figure 4:
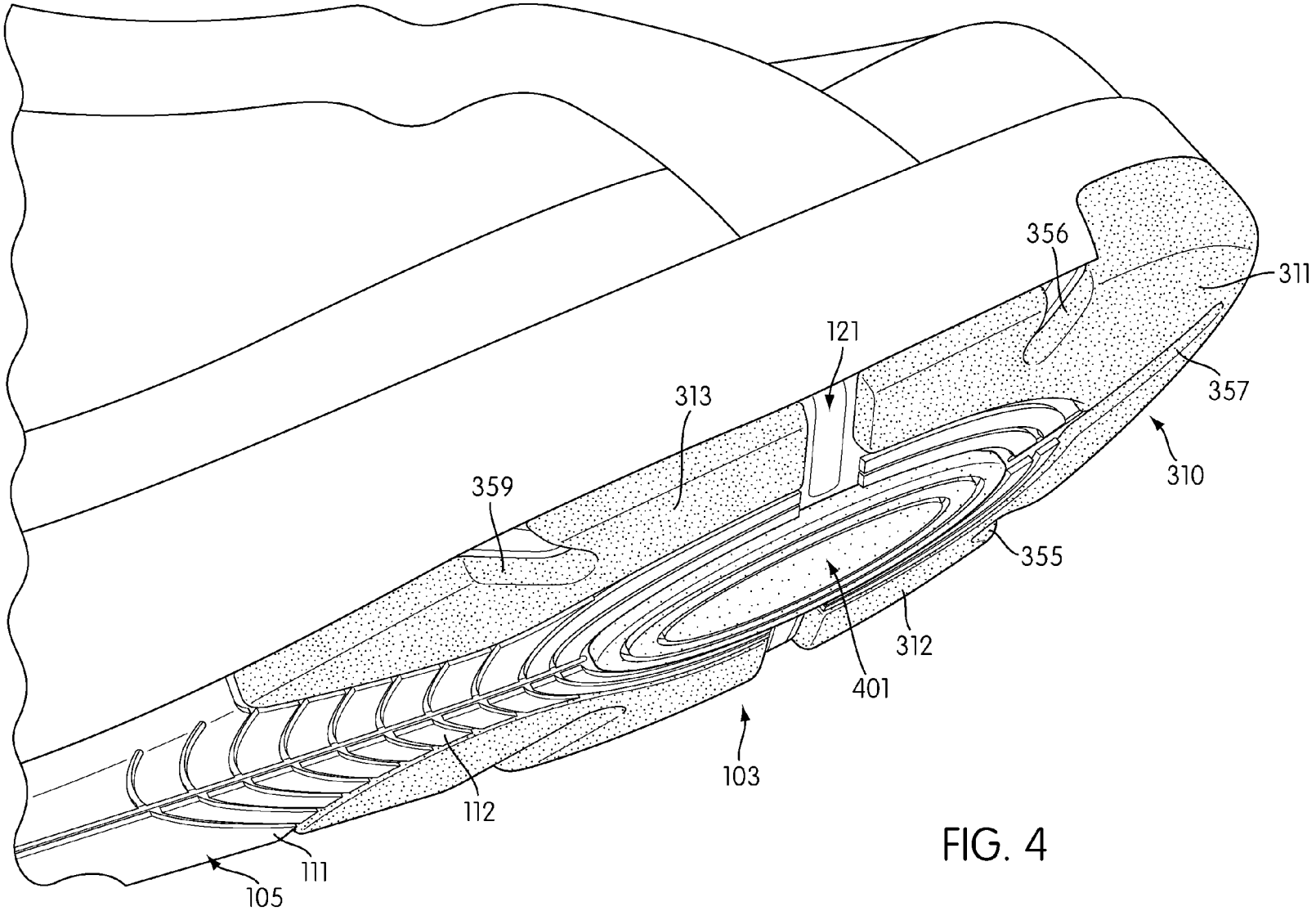
FIG. 4 is an isometric bottom view of an embodiment of a forefoot portion of an article of footwear.

Referring to FIGS. 3 and 4, sole 105 includes plurality of sole pods 310. Generally, plurality of sole pods 310 can be disposed in various locations on sole 105 to provide substantially continuous traction with a ground surface. In some embodiments, plurality of sole pods 310 may be disposed on central portion 112 of sole 105. In other embodiments, plurality of sole pods 310 can be disposed on peripheral portion 111 and central portion 112 of sole 105. In still other embodiments, plurality of sole pods 310 is disposed on peripheral portion 111 of sole 105. In one embodiment, plurality of sole pods 310 can be disposed on peripheral portion 111 of forefoot portion 103. Furthermore, plurality of sole pods 310 may comprise a high friction material. Further details of this arrangement are discussed in greater detail later in this detailed description. With this configuration, plurality of sole pods 310 can provide substantially continuous traction on peripheral portion 111 of forefoot portion 103. In particular, traction for a sole can be achieved without the use of cleats or tread elements in order to maintain a substantially flat bottom surface for the sole.

In different embodiments, plurality of sole pods 310 can include various numbers of sole pods. In an exemplary embodiment, plurality of sole pods 310 includes three sole pods disposed on forefoot portion 103. In particular, plurality of sole pods 310 includes first sole pod 311, second sole pod 312 and third sole pod 313.

In one embodiment, plurality of sole pods 310 can be disposed on forefoot portion 103 in a manner that corresponds with portions of forefoot portion 103 associated with first flex groove set 121. In particular, first sole pod 311 may correspond with first portion 151 of forefoot portion 103. Likewise, second sole pod 312 can correspond with second portion 152. In a similar manner, third sole pod 313 may correspond with third portion 153. With this arrangement, first sole pod 311, second sole pod 312 and third sole pod 313 may not interfere with the increased bending and flexing provided by first flex groove set 121.

In embodiments where sole pods are disposed above flex grooves, sole pods can include provisions to accommodate the bending and flexing of the underlying flex grooves. In some cases, sole pods can include flex grooves to accommodate bending and flexing at the underlying flex grooves. For example, referring to FIG. 3, first sole pod 311, second sole pod 312 and third sole pod 313 are configured with flex grooves that are aligned with the underlying flex grooves of first flex groove set 121 and second flex groove set 122.

In one embodiment, first sole pod 311 includes fifth flex groove 355 that corresponds with second flex groove 142 of second flex groove set 122. In addition, first sole pod 311 is configured with sixth flex groove 356 that corresponds with third flex groove 143 of second flex groove set 122. Furthermore, first sole pod 311 includes seventh flex groove 357 that is aligned with the underlying portion of longitudinal flex groove 131 of first flex groove set 121. In a similar manner, second sole pod 312 includes eighth flex groove 358 that is aligned with underlying first flex groove 141. Likewise, third sole pod 313 includes ninth flex groove 359 that is aligned with underlying fourth flex groove 144. With this configuration, plurality of sole pods 310 can accommodate the increased bending and flexing provided by first flex groove set 121 and second flex groove set 122.

In some embodiments, first portion 151, second portion 152 and third portion 153 may be configured with recesses to receive plurality of sole pods 310. However, in other embodiments, first portion 151, second portion 152 and third portion 153 may not include recesses to receive plurality of sole pods 310. In some cases, this may allow plurality of sole pods 310 to extend above bottom surface 180 of sole 105. In embodiments where recesses in portions of forefoot portion 103 receive plurality of sole pods 310, plurality of sole pods 310 may be generally flush with bottom surface 180 of sole 105.

In different embodiments, sole pods may be configured with various sizes and shapes. Examples of shapes include, but are not limited to: square shapes, rectangular shapes, elliptical shapes, triangular shapes, regular shapes, irregular shapes as well as other types of shapes. In an exemplary embodiment, first sole pod 311 is configured with an arch-like shape. Also, second sole pod 312 and third sole pod 313 are configured with rectangular-like shapes with curved portions disposed adjacent to arch portion 108 of sole 105. With this configuration, plurality of sole pods 310 may cover a substantial portion of peripheral portion 111 of forefoot portion 103.

In some embodiments, sole pods may be associated with additional portions of a sole. In an exemplary embodiment, plurality of sole pods 310 includes heel sole pod 314. Heel sole pod 314 may be disposed on heel portion 104 of sole 105.

In different embodiments, heel sole pod 314 may be disposed in various locations on heel portion 104. In some embodiments, heel sole pod 314 may be disposed on central portion 112 and/or peripheral portion 111 of heel portion 104. In one embodiment, heel sole pod 314 may be disposed on peripheral portion 111 of heel portion 104.

In an exemplary embodiment, heel sole pod 314 may be configured with a horseshoe-like shape. With this horseshoe-like shape, heel sole pod 314 may cover a substantial portion of peripheral portion 111 of heel portion 104. Using this arrangement, heel sole pod 314 can provide substantially continuous traction with a ground surface on peripheral portion 111 of heel portion 104.

In the exemplary embodiment discussed here, flexibility and traction are achieved using flex grooves and sole pods, respectively. However, it should be understood that in other embodiments flexibility and traction can be achieved using other provisions. In other words, the use of flex grooves may be optional in some embodiments. Similarly, the use of sole pods may be optional in some embodiments.

In another embodiment, a sole may be made of a material that improves both flexibility and traction for the sole. In one embodiment, for example, a sole may be made of a material comprising rubber and foam. By using a material that is both flexible and durable, the flexibility of the sole can be increased without the use of flex grooves. Furthermore, by using a material that includes rubber, the traction of the sole can be increased without the use of additional sole pads.

An article of footwear can include provisions to enable pivoting and sliding. By facilitating pivoting and sliding, an article of footwear can assist in the execution of various dance moves. In some embodiments, a pivot portion may be disposed adjacent to a ball of a foot. In other embodiments, a pivot portion may be disposed on a peripheral portion of a forefoot portion of a sole. In still other embodiments, a pivot portion may be disposed in a central portion of a forefoot portion of a foot. With this configuration, the pivot portion can facilitate sliding as well as pivoting on the central portion of the forefoot.

Figure 5:
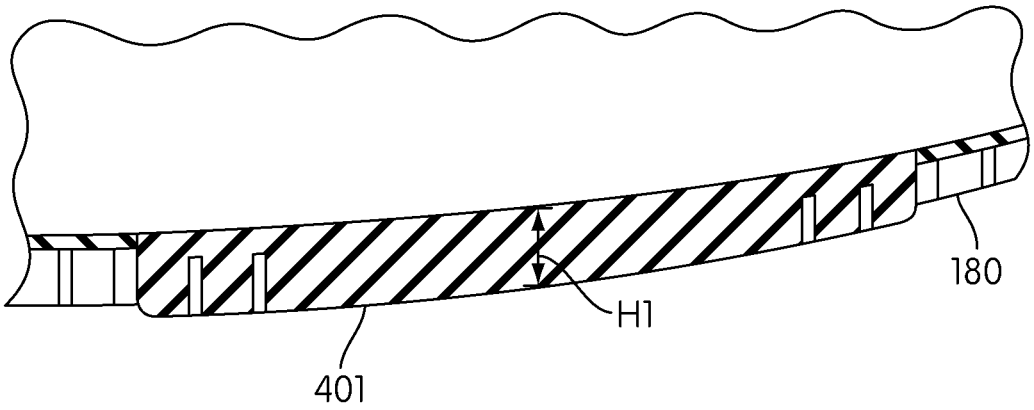
FIG. 5 is an enlarged view of an embodiment of a cross sectional profile of a central portion of a forefoot portion of a sole.

Referring to FIGS. 4 and 5, forefoot portion 103 includes pivot portion 401 to enable pivoting and/or sliding. In particular, pivot portion 401 may be disposed in central portion 112 of forefoot portion 103. In some embodiments, longitudinal flex groove 131 may extend from pivot portion 401 to heel portion 104 of sole 105, as illustrated in FIG. 3. In some cases, first flex groove set 121 may be arranged in a cross-hair like pattern around pivot portion 401. Furthermore, plurality of sole pods 310 may partially surround pivot portion 401.

In different embodiments, pivot portion 401 may be configured in various shapes. Examples of shapes include but are not limited to: circular shapes, rectangular shapes, square shapes, geometric shapes, regular shapes as well as irregular shapes. In one embodiment, pivot portion 401 comprises an ellipse-like shape.

Generally, pivot portion 401 may be configured with various sizes. In some embodiments, pivot portion 401 may be configured with a greater size in a lateral direction than a longitudinal direction. In other embodiments, pivot portion 401 may be oriented in a diagonal direction so that pivot portion 401 comprises a greater size in a diagonal direction than either a lateral or longitudinal direction. In an exemplary embodiment, pivot portion 401 comprises a greater size in a longitudinal direction than a lateral direction. In other words, the ellipse-like shape of pivot portion 401 is oriented in a longitudinal direction on sole 105.

In different embodiments, pivot portion 401 may be flush, recessed or raised with respect to bottom surface 180 of sole 105. In some embodiments, pivot portion 401 may be raised with respect to substantially flat bottom surface 180 of sole 105. In some embodiments, pivot portion 401 may be configured to resist depression when the full weight of the wearer is on forefoot portion 103. In an exemplary embodiment, pivot portion 401 may be configured to depress slightly when the full weight of a wearer is on forefoot 103.

Referring to FIG. 5, pivot portion 401 may be configured with height H1 with respect to substantially flat bottom surface 180. Generally, height H1 can be various values configured to raise pivot portion 401 above substantially flat bottom surface 180. In some embodiments, height H1 may have a value that allows pivot portion 401 to contact a ground surface without plurality of sole pods 310 contacting the ground surface. In an exemplary embodiment, height H1 may have a value that raises pivot portion 401 above bottom surface 180 but still allows plurality of sole pods 310 to contact the ground surface when the full weight of a wearer is on forefoot portion 103.

A sole of an article of footwear can include provisions for facilitating contact with a ground surface when the article is in different positions. In some embodiments, a sole can have varying coefficients of friction associated with different portions of the sole. In other words, some portions of a sole can have higher coefficients of friction than other portions of the sole. For example, in some embodiments, a periphery of a sole can be stickier than a pivot portion. With this arrangement, a dancer can easily drag a foot over a ground surface by engaging the pivot portion of the sole. Also, the dancer can easily gain increased traction with the ground surface by engaging the peripheral portion of the sole. This allows a dancer to seemingly "glide" across the ground surface during some dance moves and also to perform other types of moves that require a large degree of friction with the ground surface.

In one embodiment, pivot portion 401 can be associated with a first coefficient of friction. Similarly, sole pods of plurality of sole pods 310 may be associated with a second coefficient of friction. The first coefficient of friction may be substantially less than the second coefficient of friction. With this configuration, pivot portion 401 may allow a wearer to easily drag article of footwear 100 across a ground surface. Also, plurality of sole pods 310 can provide greater traction capabilities for a wearer by engaging peripheral portion 111 with a ground surface.

Generally, each component of article of footwear 100 may be constructed of any material. Sole system 105 may be constructed from any suitable material, including but not limited to: elastomers, siloxanes, natural rubber, other synthetic rubbers, aluminum, steel, natural leather, synthetic leather, or plastics. Sole pods of plurality of sole pods 310 may be made of materials with a high coefficient of friction, including, but not limited to: elastomers, siloxanes, natural rubber, other synthetic rubbers as well as other materials. In an exemplary embodiment, sole pods of plurality of sole pods 310 may be made of rubber. In addition, pivot portion 401 can be made of materials with a low coefficient of friction, including, but not limited to: low friction rubber, plastics, polyurethane as well as other materials. In some cases, central portion 112 of forefoot portion 103 may comprise a similar material as pivot portion 401. In other cases, central portion 112 of forefoot portion 103 may comprise a different material than pivot portion 401.

In embodiments where article 100 is a dance shoe, the low coefficient of friction of pivot portion 401 can allow a dancer to slide or drag article 100 across a ground surface. As a dancer plants article 100, plurality of sole pods 310 engage peripheral portion 111 with a ground surface to provide traction to prevent slipping.

Typically, when a dancer pivots, a peripheral portion of a sole may not conform to the ground surface due to the rigidity of the peripheral portion. Without conforming to the ground surface, the peripheral portion of the sole fails to provide flexibility for the dancer. For example, a rigid peripheral portion may limit the amount that a dancer may pivot. Instead, flex grooves in the peripheral portion may allow a forefoot portion to conform to a ground surface to provide greater flexibility for a dancer. In particular, the use of radially extending flex grooves may allow the sole to flex in many different directions during pivoting motions. In contrast, flex grooves oriented in a single direction with respect to the sole may only provide bending of the sole in a particular direction.

Figure 6:
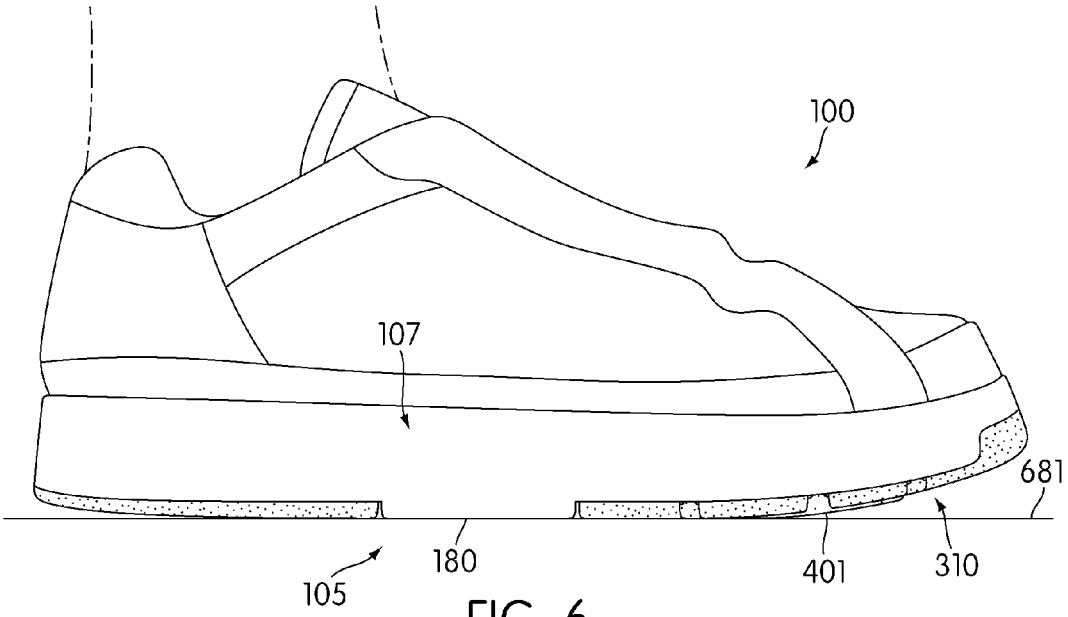
FIG. 6 is a side view of an embodiment of an article of footwear in a substantially flat position with a ground surface.
Figure 7:
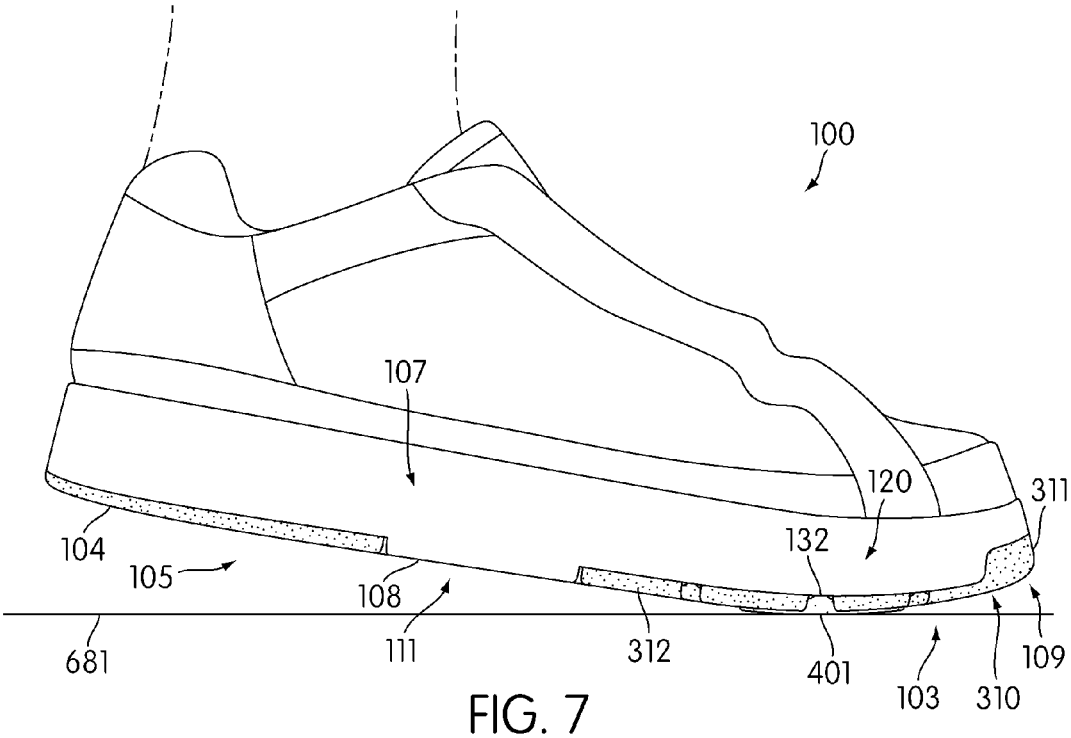
FIG. 7 is a side view of an embodiment of an article of footwear pivoting forward.

FIGS. 6-9 illustrate an embodiment of article of footwear 100 pivoting in various directions. In particular, FIGS. 6 and 7 illustrate a lateral side view of an embodiment of article of footwear 100 pivoting forward. Referring to FIG. 6, article of footwear 100 is in a substantially flat position. In the substantially flat position, bottom surface 180 of sole 105 is substantially flush with ground surface 681. In particular, pivot portion 401 and plurality of sole pods 310 are in contact with ground surface 681.

Referring to FIG. 7, heel portion 104 and arch portion 108 rise from ground surface 681 as a dancer pivots article 100 forward onto pivot portion 401. As the dancer pivots onto pivot portion 401, plurality of flex grooves 120 disposed on peripheral portion 111 flex to adapt to the pivoting of article 100. For example, lateral flex groove 132 flexes to allow a portion of second sole pod 312 to rise from ground surface 681 to adapt to the forward pivoting of article 100. Third sole pod 313, not shown for purposes of clarity, may also rise from ground surface 681 as lateral flex groove 132 flexes to accommodate the pivoting. Furthermore, other flex grooves of plurality of flex grooves 120, not shown for purposes of illustration, can also flex to adapt to the pivoting and enable a portion of forefoot portion 103 to rise from ground surface 681. By adapting to the pivoting of article 100, plurality of flex grooves 120 allow peripheral portion 111 to bend away from pivot portion 401, which allows a dancer to more easily turn on pivot portion 401. Additionally, this arrangement allows a dancer to smoothly glide their feet by dragging the article across a ground surface with only the pivot portion exposed to the surface, which allows for significantly less friction than when the sole pods are engaged.

A sole can include provisions for enhancing forefoot rotational traction, which allows a dancer to pivot and stop. In some cases, sole pods 310 may enhance the ability of a dancer to pivot and stop. In other words, sole pods 310 can provide a breaking traction at peripheral portion 111 during a pivoting motion. In other embodiments, however, forefoot rotational traction can be achieved in other manners. For example, in another embodiment, using a midsole with a high degree of traction can facilitate pivoting and stopping.

Figure 8:
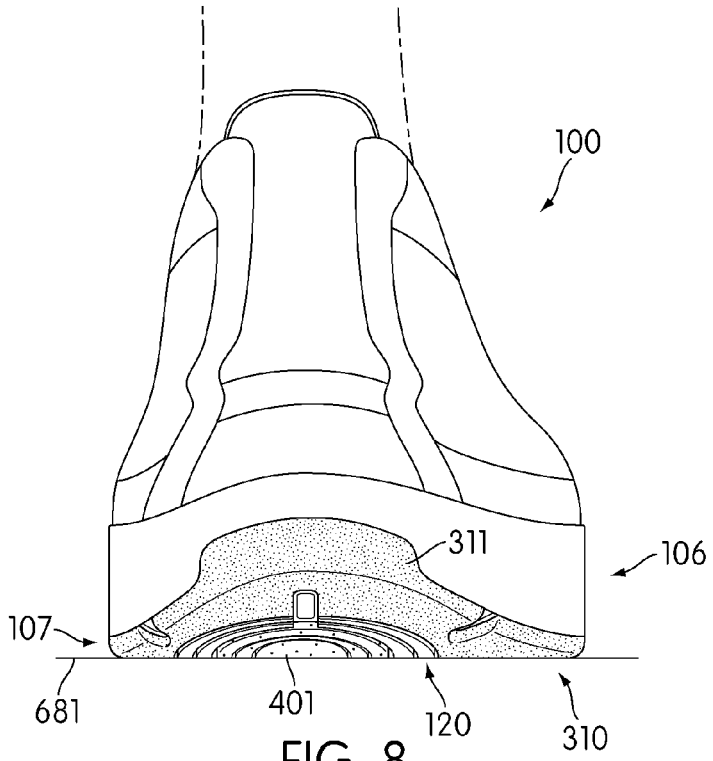
FIG. 8 is a front view of an embodiment of an article of footwear in a substantially flat position with a ground surface.
Figure 9:
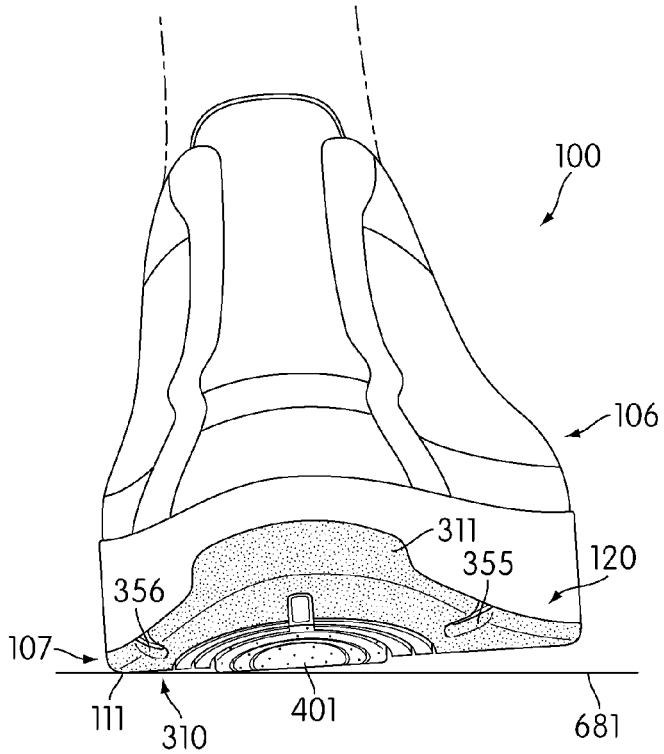
FIG. 9 is a front view of an embodiment of an article of footwear pivoting to a lateral side.

Referring to FIGS. 8 and 9, article 100 moves from a substantially flat position to a laterally pivoting position. In particular, FIG. 8 illustrates a front isometric view of an embodiment of article 100 in a substantially flat position. In this substantially flat position, plurality of sole pods 310 and pivot portion 401 contact ground surface 681.

Referring to FIG. 9, a dancer may pivot article 100 by some amount and then stop. In this embodiment, a dancer can press lateral portion 107 of peripheral portion 111 against ground surface 681. In particular, one or more of sole pods 310 may engage ground surface 681 to provide enhanced traction and stopping ability. It should be understood that in some cases other portions of peripheral portion 111 may engage ground surface 681 to stop a pivoting motion. With this arrangement, a dancer can perform quick and precise pivoting moves in various directions.

In some cases, the flexibility of sole 105 can enhance the stability of article 100 as a dancer leans on peripheral portion 111 to stop a pivoting motion. In some cases, medial portion 106 may rise from ground surface 681 as a dancer pivots onto lateral portion 107. With the flexibility provided by plurality of flex grooves 120, lateral portion 107 of peripheral portion 111 conforms to ground surface 681 instead of tipping over onto a peripheral edge of peripheral portion 111. In one embodiment, fifth flex groove 355 and sixth flex groove 356 both flex to facilitate this pivoting motion. Although not shown for purposes of clarity, it should be understood that additional flex grooves of plurality of flex grooves 120 may also flex as a dancer pivots. Using this arrangement, lateral portion 107 of peripheral portion 111 may remain engaged with ground surfaced 681 to provide increased traction for a dancer pivoting to a lateral side. It should be understood that plurality of flex grooves 120 can also accommodate medial pivoting in a similar manner.

By using a pivot portion in combination with a highly flexible forefoot portion, a dancer can more easily pivot in substantially any direction as the sole may bend to enhance contact between the pivot portion and the ground. Furthermore, providing increased traction along a peripheral portion of the sole enhances the ability of a dancer to pivot and stop.

Figure 10:
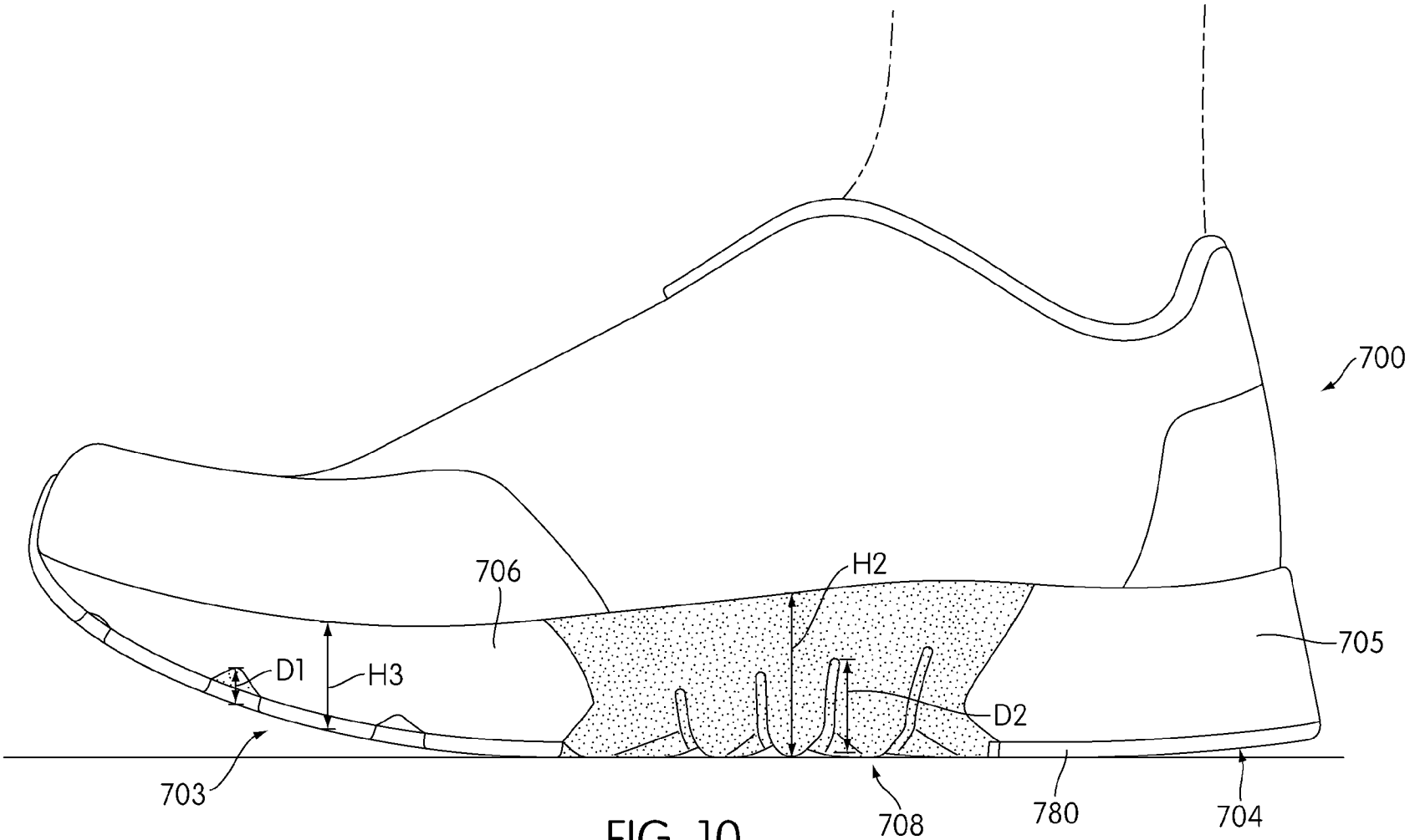
FIG. 10 is a side view of an embodiment of an article of footwear.
Figure 11:
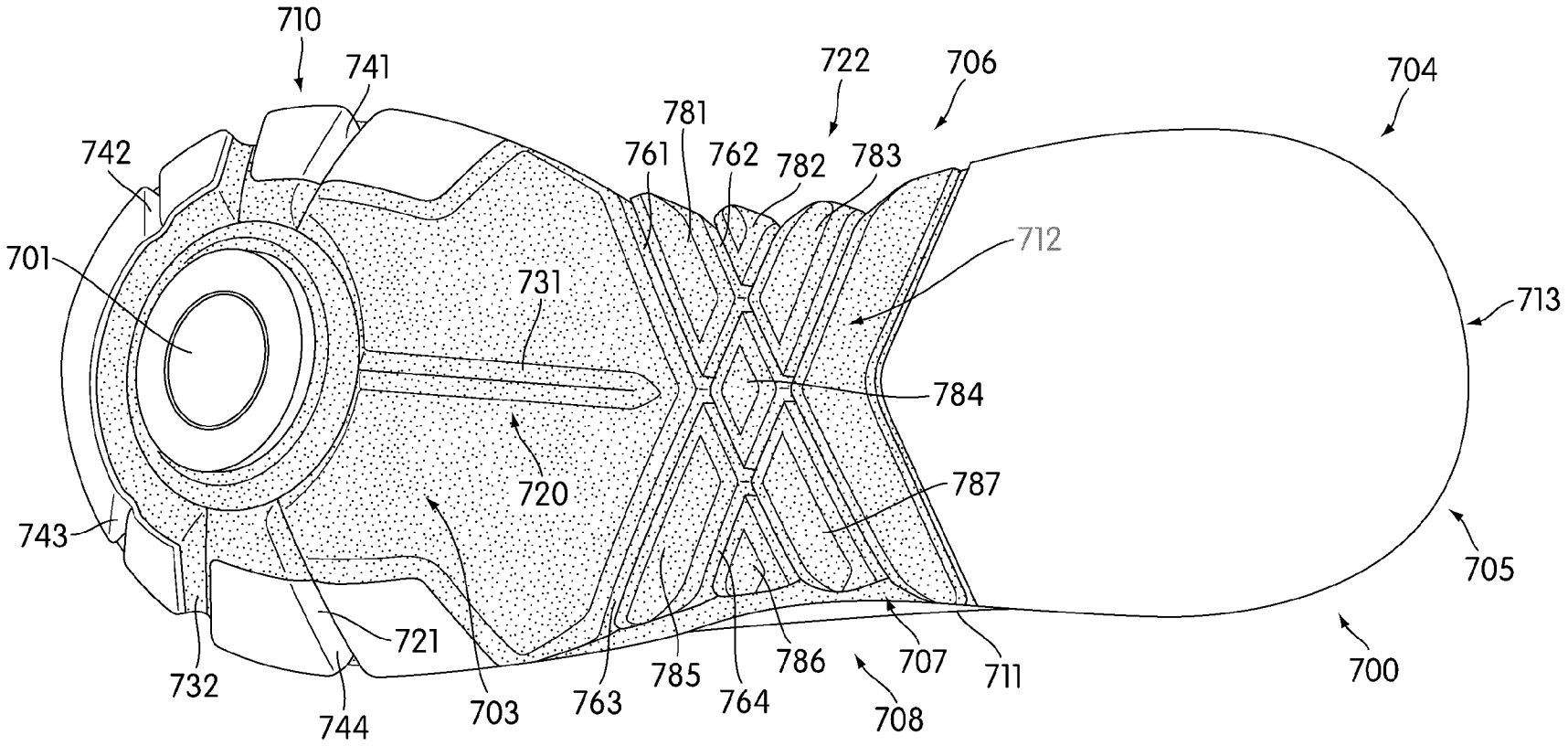
FIG. 11 is a bottom view of an embodiment of an article of footwear.

FIGS. 10 and 11 illustrate an exemplary embodiment of article 700. In particular FIG. 10 is a side view of an embodiment of article 700 and FIG. 11 is a bottom view of an embodiment of article 700. In one embodiment, article 700 may be configured with similar features discussed in respect to article 100 of the previous embodiment. In particular, sole 705 of article 700 includes pivot portion 701 to facilitate pivoting and sliding. The pivot portion may be a round pad surrounded by a round groove. For example, as shown in FIG. 11, pivot portion 701 may be a round pad surrounded by a round groove. The pivot portion may be a circular pad. For example, as shown in FIG. 11, pivot portion 701 may be a circular pad.

In some embodiments, sole 705 includes plurality of sole pods 710. Plurality of sole pods 710 may be disposed on peripheral portion 711 of sole 705. In particular, plurality of sole pods 710 includes three sole pods disposed on forefoot portion 703 of sole 705. Also, plurality of sole pods 710 comprises heel sole pod 713 disposed on heel portion 704 of sole 705. With this arrangement, plurality of sole pods 710 can provide substantially continuous traction on peripheral portion 711 of forefoot portion 703 and heel portion 704 of sole 705.

In some embodiments, sole 705 may also include plurality of flex grooves 720 to facilitate bending of sole 705. Referring to FIG. 11, plurality of flex grooves 720 includes first flex groove set 721. First flex groove set 721 is disposed on forefoot 703 of sole 705. In some cases, first flex groove set 721 includes longitudinal flex groove 731 and lateral flex groove 732. Similar to the previous embodiment of article 100, lateral flex groove 732 extends in a lateral direction across forefoot 703. Likewise, longitudinal flex groove 731 extends in a longitudinal direction on sole 705. However, in this embodiment, longitudinal flex groove 731 extends only through forefoot portion 703 and a portion of arch portion 708 of sole 705.

In some embodiments, first flex groove set 721 includes first flex groove 741, second flex groove 742, third flex groove 743 and fourth flex groove 744. First flex groove 741, second flex groove 742, third flex groove 743 and fourth flex groove 744, as well as longitudinal flex groove 731 and lateral flex groove 732, extend in a radial direction from pivot portion 701. In particular, plurality of flex grooves 720 is arranged in a cross-hair like pattern around pivot portion 701. With this arrangement, plurality of sole pods 710 can facilitate the bending of central portion 712 of sole 705 and peripheral portion 711.

An article of footwear can include provisions for increasing the flexibility of an arch portion of a sole. In some embodiments, an arch portion of a sole may comprise a flexible material to increase the flexibility of the arch portion of the article. In other embodiments, an arch portion of a sole may be configured with flex grooves to increase the flexibility of the arch portion of the sole. With this arrangement, an arch portion of a sole may have increased flexibility while maintaining stability of the arch portion of the sole.

In some embodiments, plurality of flex grooves 720 includes second flex groove set 722. Second flex groove set 722 is associated with arch portion 708 of sole 705. Generally, second flex groove set 722 may be associated with various numbers of flex grooves. In some cases, second flex groove set 722 may include more than four flex grooves. In other cases, second flex groove set 722 can include less than four flex grooves. In one embodiment, second flex groove set 722 includes four flex grooves. In particular, second flex groove set 722 includes first flex groove 761, second flex groove 762, third flex groove 763 and fourth flex groove 764.

Generally, second flex groove set 722 may be arranged in various patterns on arch portion 708. In some embodiments, flex grooves of second flex groove set 722 may be arranged so that the flex grooves do not intersect. In other embodiments, flex grooves of second flex groove set 722 may be arranged with intersecting flex grooves. In one embodiment, second flex groove set 722 may be arranged with flex grooves intersecting in an "x"-like configuration.

In an exemplary embodiment, first flex groove 761 and second flex groove 762 may be substantially parallel with each other. In particular, first flex groove 761 and second flex groove 762 may extend diagonally from medial portion 706 of sole 705 to lateral portion 707 of sole 705. In a similar manner, third flex groove 763 and fourth flex groove 764 can be arranged substantially parallel with each other. In particular, third flex groove 763 and fourth flex groove 764 may extend diagonally from lateral portion 707 to medial portion 706. With this arrangement, flex grooves of second flex groove set 722 may intersect to form an "x"-like configuration.

In embodiments with intersecting flex grooves of second flex groove set 722, arch portion 708 may also include first portion 781, second portion 782 and third portion 784. First portion 781, second portion 782 and third portion 783 may be associated with medial portion 706 of peripheral portion 711. In particular, first portion 781 may be disposed adjacent to first flex groove 761 and second flex groove 762 as third flex groove 763 intersects first flex groove 761 and second flex groove 762. Similarly, second portion 782 may be disposed adjacent to the intersection of second flex groove 762 and third flex groove 763. Likewise, third portion 783 may be disposed adjacent to third flex groove 763 and fourth flex groove 764 as second flex groove 762 intersects third flex groove 763 and fourth flex groove 764.

In addition, arch portion 708 may also include fourth portion 784. Fourth portion 784 may be circumscribed by the four intersections of second flex groove set 722. With this arrangement, fourth portion 784 may be associated with central portion 712 of arch portion 708.

Arch portion 708 may also include fifth portion 785, sixth portion 786 and seventh portion 787. In one embodiment, fifth portion 785, sixth portion 786 and seventh portion 787 may be associated with lateral portion 707 of sole 705. In particular, fifth portion 785 may be disposed on lateral portion 707 adjacent to third flex groove 763 and fourth flex groove 764 as third flex groove 763 and fourth flex groove 764 intersect first flex groove 761. Likewise, sixth portion 786 may be disposed adjacent to the intersection of fourth flex groove 764 and first flex groove 761. Also, seventh portion 787 may be disposed adjacent to first flex groove 761 and second flex groove 762 as first flex groove 761 and second flex groove 762 intersect with fourth flex groove 764.

This arrangement of plurality of flex grooves 720 can enable bending and twisting of portions of arch portion 708. However, with a limited number of flex grooves, plurality of flex grooves 720 may not interfere with the stability of arch portion 708. With this arrangement, plurality of flex grooves 720 can accommodate some twisting and bending while maintaining stability of arch portion 708.

An article of footwear can include provisions for varying flexibility over different portions of a sole. In some embodiments, flex grooves with varying widths can be disposed in different portions of a sole to vary the flexibility of different portions of the sole. In other embodiments, flex grooves comprising different average depths can be disposed in different portions on a sole to vary the flexibility of different portions of the sole. In some cases, flex grooves with greater depths may accommodate greater flexibility than more shallow flex grooves.

Referring to FIG. 10, first flex groove set 721 may be associated with first average depth D1. The term "average depth" as used throughout this detailed description and in the claims, refers to an average depth of a set of flex grooves as the flex grooves extend from a bottom surface of the sole into the sole. In other words, flex grooves of first flex groove set 721 extend various depths from bottom surface 780 of sole 705 into sole 705. These depths may be averaged to associate first flex groove set 721 with first average depth D1. In a similar manner, second flex groove set 722 can be associated with second average depth D2.

Although average depth D2 is associated with second flex groove set 722, it should be understood that the depths of flex grooves of second flex groove set 722 may vary. In some embodiments, flex grooves of second flex groove set 722 may have a shallower depth when disposed adjacent to forefoot portion 703. Likewise, flex grooves of second flex groove set 722 may have a greater depth when disposed adjacent to heel portion 704. In one embodiment, first flex groove 761 disposed adjacent to forefoot portion 703 on medial portion 706 may have a more shallow depth than fourth flex groove 764 disposed adjacent to heel portion 704 on medial portion 706. Using this arrangement, second flex groove set 722 may provide greater flexibility to a portion of arch portion 708 adjacent to heel portion 704 than a portion of arch portion 708 adjacent to forefoot portion 703.

The height of sole 705 may also vary and accommodate different depths of flex grooves. In some embodiments, sole 705 may comprise second height H2 at arch portion 708. In addition, sole 705 may be configured with third height H3 at forefoot portion 703. In some cases, second height H2 at arch portion 708 may be a relatively tall height. In contrast, sole 705 may comprise a more shallow third height H3 at forefoot portion 703.

In some embodiments, second average depth D2 of second flex groove set 722 may be less than first average depth D1 of first flex groove set 721. In still other embodiments, second average depth D2 may be substantially equal to first average depth D1. In an exemplary embodiment, first average depth D1 may be substantially less than second average depth D2. In some cases, first average depth D1 may be a value corresponding to relatively deep flex grooves. This may allow second flex groove set 722 to provide more flexibility for arch portion 708 than first flex groove set 721 provides for forefoot portion 703. With this arrangement, forefoot portion 703 may have more stability than arch portion 708.

Figure 12:
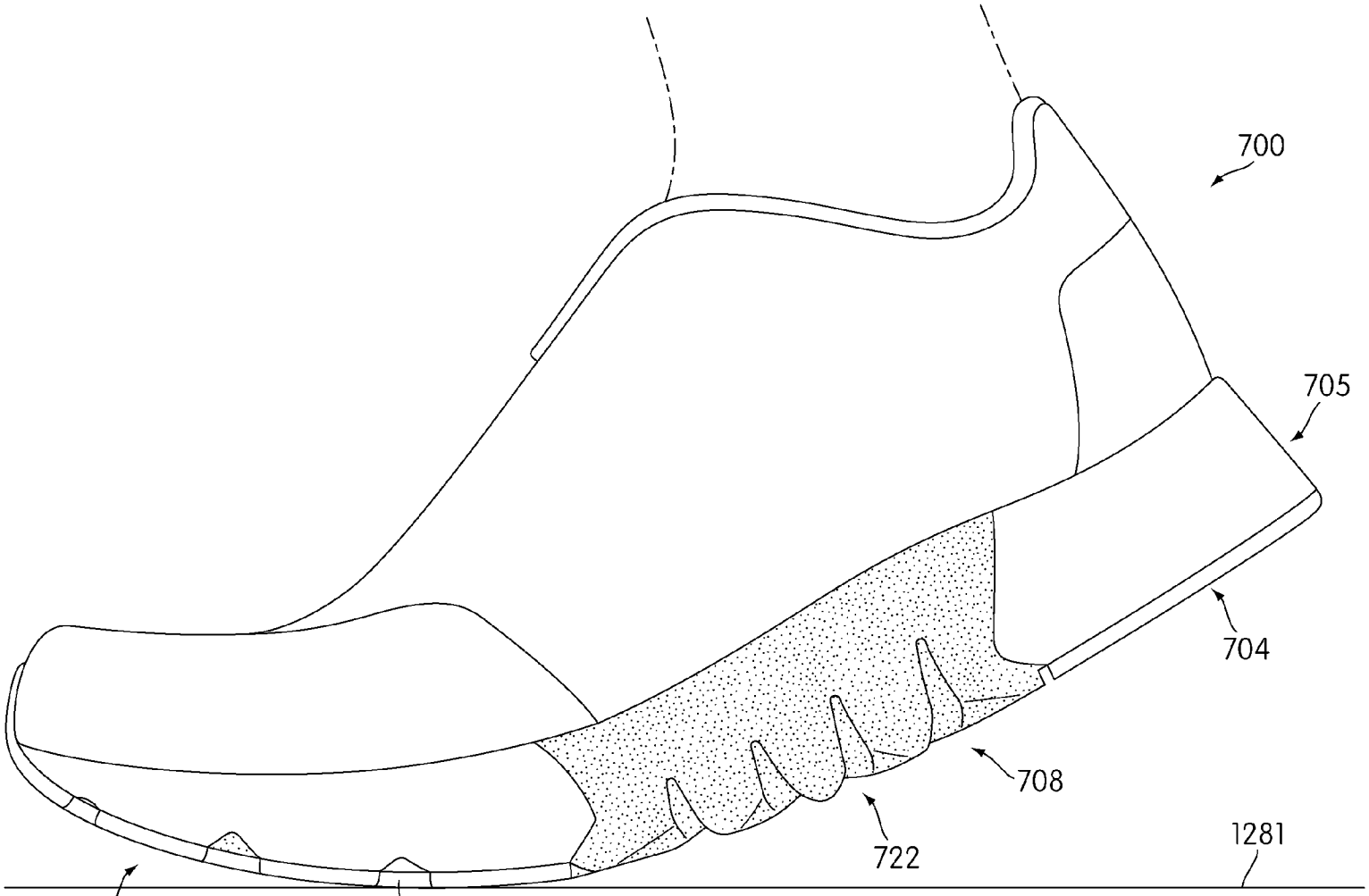
FIG. 12 is a side view of an embodiment of an article of footwear undergoing flexing.

In order to support a dancer when the dancer places a substantial portion of weight on a forefoot, the forefoot portion of a sole can be configured to provide stability. Referring to FIG. 12, a dancer plants forefoot portion 703 on ground surface 1281 while raising arch portion 708 and heel portion 704 off of ground surface 1281. In particular, flex grooves of second flex groove set 722 flex to allow arch portion 708 to bend. In contrast, first flex groove set 721 does not interfere with the stability of forefoot portion 703. With this arrangement, sole 705 provides flexibility and stability for a dancer wearing article of footwear 700.

Flex grooves can be configured to accommodate bending in a first direction while preventing bending in a second direction. In some embodiments, relatively deep flex grooves disposed in a tall sole may accommodate bending in a first direction while preventing bending in a second direction. In some cases, flex grooves can assist in preventing pronation of a foot by preventing bending in a second direction.

Second flex groove set 722 may accommodate bending in a first bending direction. The term "first bending direction" as used in this detailed description and in the claims, refers to the direction associated with a toe portion moving upwards towards a shin. In some cases, second flex groove set 722 may accommodate bending in a first bending direction when article 700 arches to raise heel portion 704, as illustrated in FIG. 12.

As previously discussed, arch portion 708 is configured with a relatively tall second height H2. In addition, flex grooves of second flex groove set 722 have a relatively deep depth D1. This arrangement can allow second flex groove set 722 to substantially prevent bending in a second bending direction. The term "second bending direction" as used in this detailed description and in the claims, refers to the direction associated with a pointed forefoot portion moving toward a heel portion of a foot.

Figure 13:
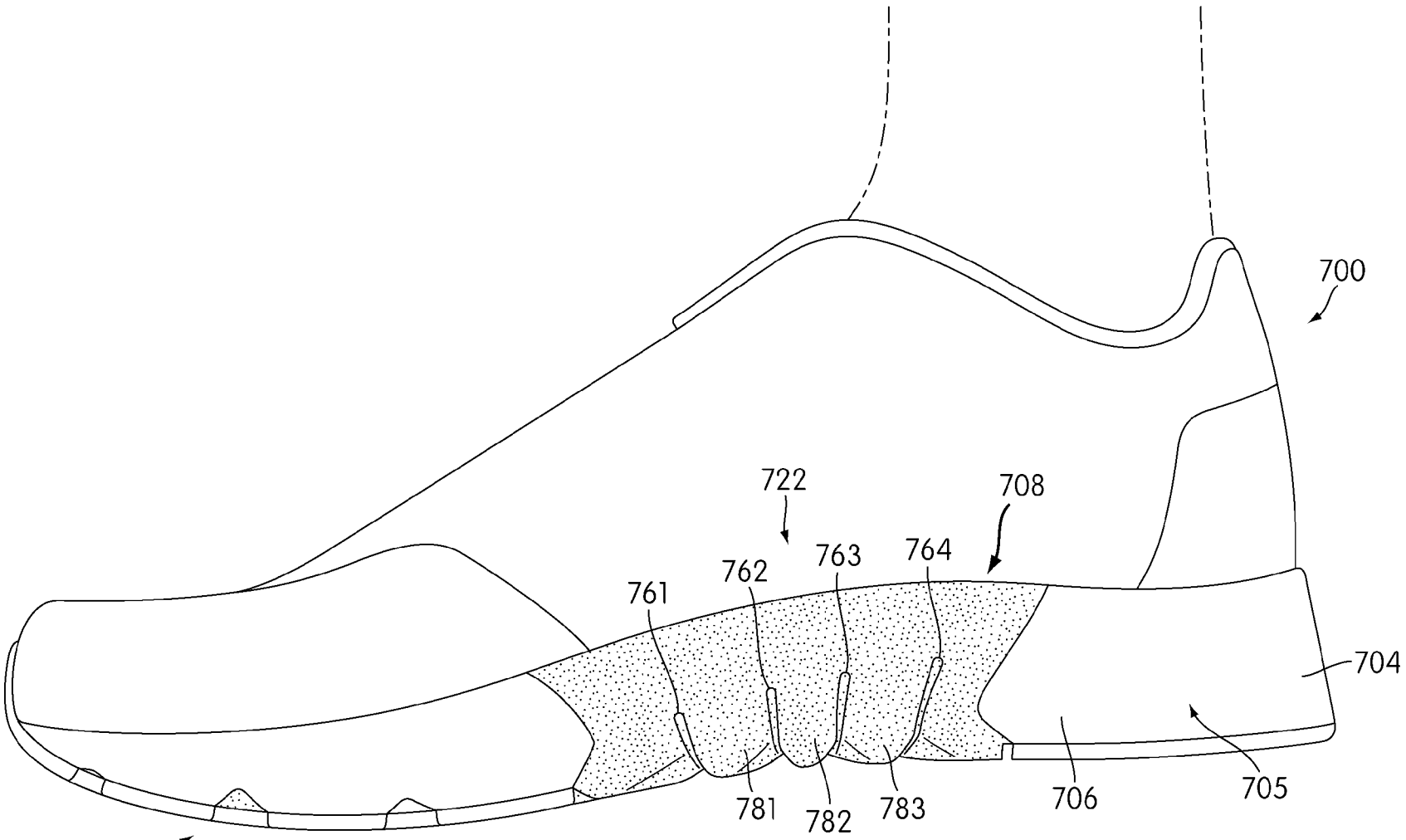
FIG. 13 is a side view of an embodiment of an article of footwear undergoing flexing.

Referring to FIG. 13, a dancer is moving article 700 in a second bending direction. As the dancer attempts to move forefoot portion 703 toward heel portion 704, flex grooves of second flex groove set 722 may be pinched together by adjacent portions to prevent further movement in a forward rotating direction. For example, first flex groove 761 may be pinched together on medial portion 706 by an adjacent portion of arch portion 708 and first portion 781. Likewise, second flex groove 762 may be pinched together on medial portion 706 by adjacent first portion 781 and second portion 782. Also, third flex groove 763 may be pinched together on medial portion 706 by adjacent second portion 782 and third portion 783. Finally, fourth flex groove 764 may be pinched together on medial portion 706 by third portion 783 and an adjacent portion of arch portion 708. Although only medial portion 706 is illustrated in FIG. 13 for purposes of clarity, it should be understood that flex grooves of second flex groove set 722 may also be pinched together on central portion 712 and lateral portion 707. As flex grooves of second flex groove set 722 are pinched together, second flex groove set 722 substantially prevents further movement in a second bending direction. With this arrangement, second flex groove set 722 may substantially reduce pronation of a foot disposed within article 700.

In different embodiments the depth of one or more flex grooves can vary. In some cases, each flex groove of a flex groove set can have a substantially constant depth. In other cases, the depth of one or more flex grooves can vary along the length of the flex groove. Furthermore, different flex grooves of a flex groove set can have substantially different depths.

Figure 14:
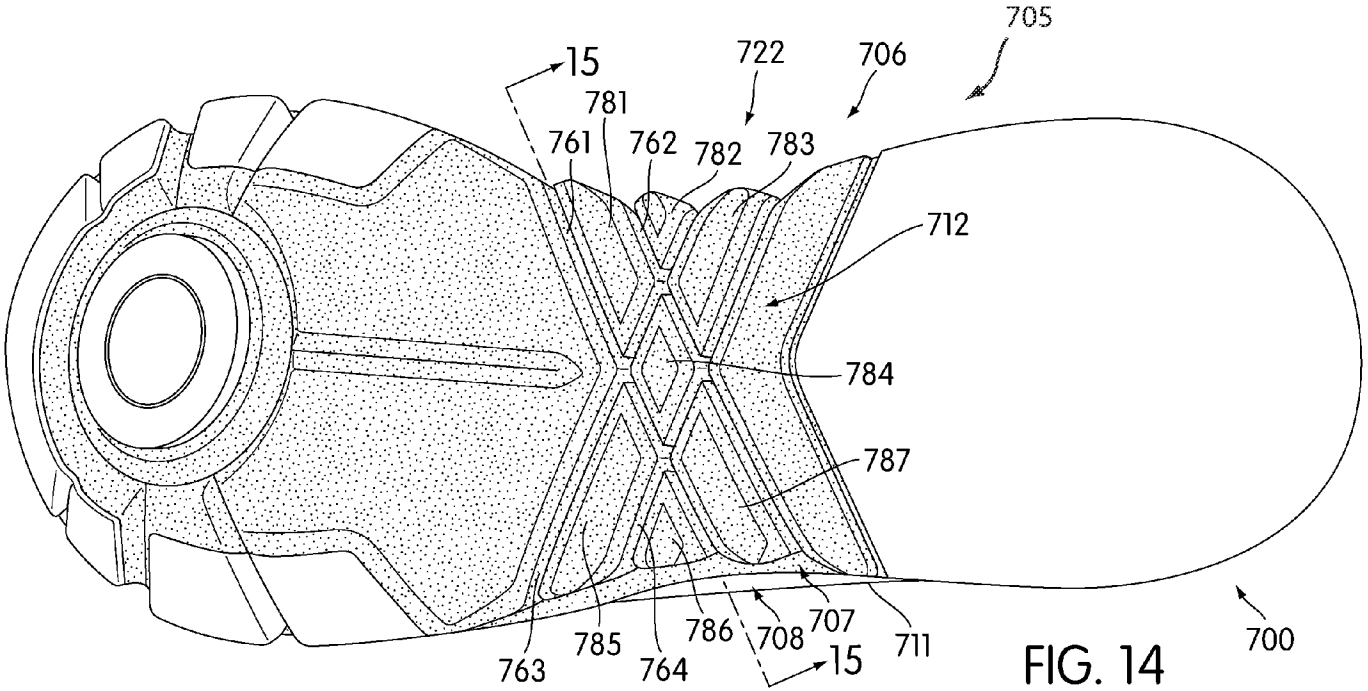
FIG. 14 is an isometric bottom view of an embodiment of an article of footwear.
Figure 15:
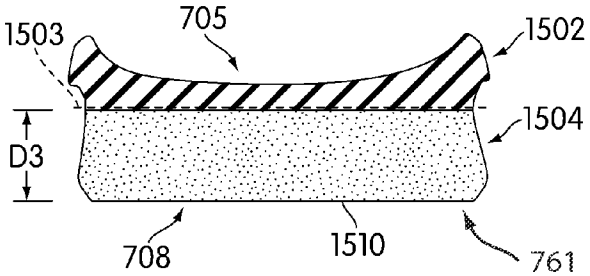
FIG. 15 is a cross sectional view of an embodiment of an article of footwear.

Referring to FIG. 14, article 700 includes first flex groove 761, as previously discussed. In this exemplary embodiment, the depth of first flex groove 761 may be substantially constant over the length of first flex groove 761. Referring to FIG. 15, sole 705 includes base portion 1502 and extended portion 1504. Base portion 1502 may be separated from extended portion 1504 by intermediate surface 1503. Generally, intermediate surface 1503 corresponds to the upper end portion of first flex groove 761. In other words, first flex groove 761 extends through lower portion 1504 but first flex groove 761 does not extend into base portion 1502. Furthermore, sole 705 includes outer sole surface 1510 that is a substantially flat ground engaging surface. In this embodiment, the depth of first flex groove 761 corresponds to the distance between intermediate surface 1503 and outer sole surface 1510.

As seen in FIG. 15, first flex groove 761 has a depth D3 that is substantially constant over the length of first flex groove 761. In some cases, the remaining flex grooves of second flex groove set 722 can have substantially similar constant depths. As previously discussed, this arrangement allows for increased flexibility in a first direction associated with a toe portion extended upwards and towards a shin.

Figure 16:
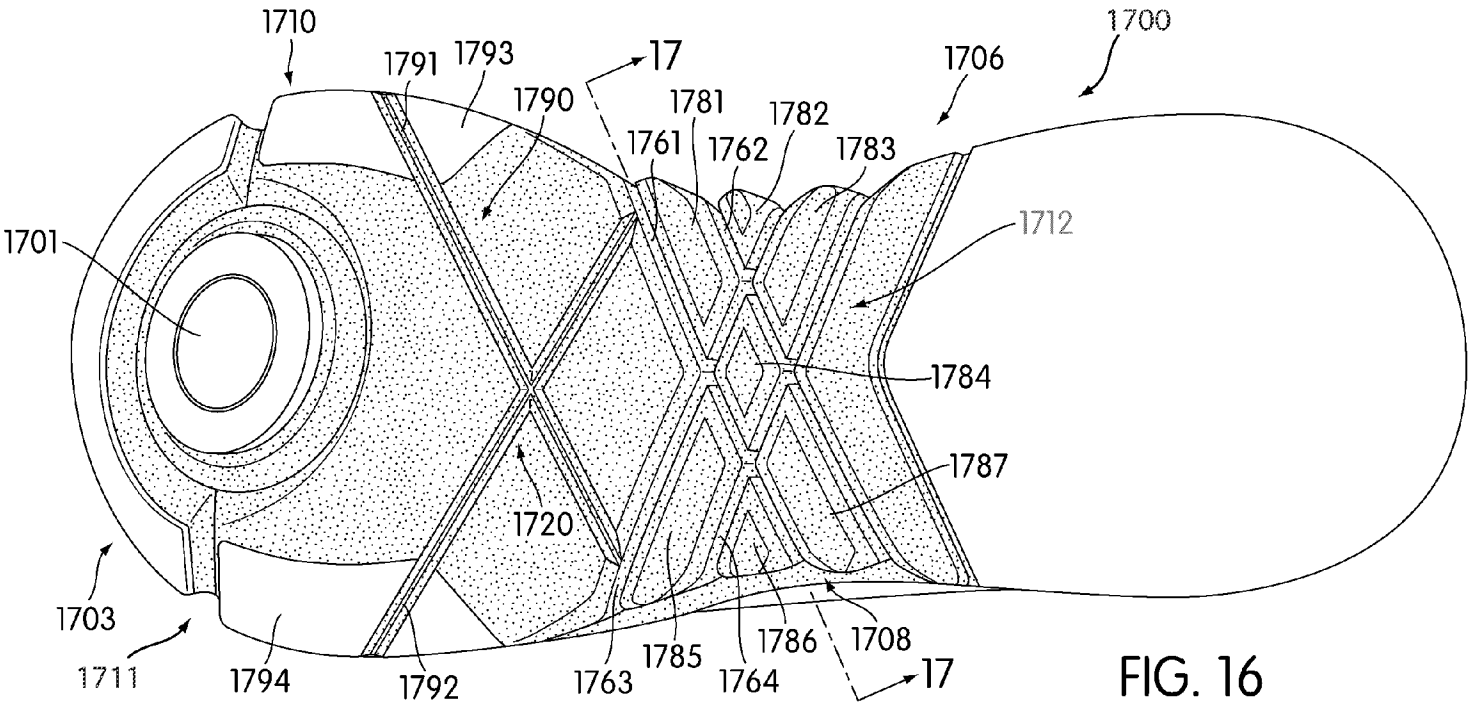
FIG. 16 is an isometric bottom view of an embodiment of an article of footwear.
Figure 17:
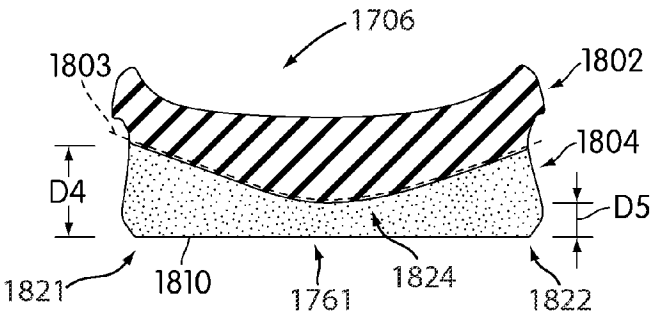
FIG. 17 is a cross sectional view of an embodiment of an article of footwear.

In another embodiment, illustrated in FIGS. 16 and 17, the depth of a flex groove may vary along the length of the flex groove. Referring to FIG. 16, article 1700 is another embodiment of a dance shoe. In particular, article 1700 may include some or all of the features associated with previous embodiments discussed in this detailed description. For example, sole 1706 of article 1700 can include pivot portion 1701, first flex groove set 1711 and plurality of sole pods 1710.

Furthermore, article 1700 can include second flex groove set 1712 disposed on arch portion 1708. Second flex groove set 1712 comprises first flex groove 1761, second flex groove 1762, third flex groove 1763 and fourth flex groove 1764. In some cases, each flex grooves of second flex groove set 1712 can be arranged in a similar manner to the flex grooves of the previous embodiments. In particular, second flex groove set 1712 may divide arch portion 1708 into first portion 1781, second portion 1782, third portion 1783, fourth portion 1784, fifth portion 1785, sixth portion 1786 and seventh portion 1787, each of which can articulate partially independently.

In this embodiment, one or more flex grooves of second flex groove set 1712 may have a non-constant depth. For example, in some cases, first flex groove 1761 may have a depth that varies over the length of first flex groove 1761. Referring to FIG. 17, sole 1706 may include base portion 1802 and extended portion 1804 that are separated by intermediate surface 1803. Furthermore, sole 1706 includes outer sole surface 1810 that may be a substantially flat ground engaging surface. In this embodiment, the depth of first flex groove 1761 corresponds to the distance between intermediate surface 1803 and outer sole surface 1810.

In this embodiment, first flex groove 1761 has a variable depth. In particular, first flex groove 1761 has a depth D4 at first peripheral edge 1821 and second peripheral edge 1822 of sole 1706. Likewise, first flex groove 1761 has a depth D5 at central portion 1824, which is disposed between first peripheral edge 1821 and second peripheral edge 1822. Furthermore, the depth of first flex groove 1761 decreases between first peripheral edge 1821 and central portion 1824. Likewise, the depth of first flex groove 1761 also decreases between second peripheral edge 1821 and central portion 1824.

In different embodiments, the shape of intermediate surface 1803, which corresponds to the depth of first flex groove 1761, can vary. In particular, the cross-sectional shapes of intermediate surface 1803 can be associated with any shapes including, but not limited to, convex shapes, concave shapes, elliptic shapes, rounded shapes, polygonal shapes, triangular shapes, as well as any other types of shapes.

In addition, the depths of each flex groove associated with an arch portion of a sole can be varied along the length of the flex groove. In some cases, each flex groove of a flex groove set can have a depth that varies in a similar manner to first flex groove 1761. In other cases, however, only some flex grooves of a flex groove set may have a varying depth.

By varying the depths of one or more flex grooves, the flexibility properties of a portion of a sole can be fine tuned. For example, using a substantially constant depth for each flex groove in a flex groove set may allow for enhanced bending along an axis between a toe portion and a heel portion. In contrast, using flex grooves with depths that vary along the lengths of the flex grooves can enhance torsion properties of the sole. Furthermore, using a combination of flex grooves with varying heights and flex grooves with constant heights allows for tuning of both bending and torsion properties of a portion of a sole.

A sole can also include provisions for increasing stability in one or more portions of the sole. In some cases, for example, a sole can include one or more ribs to help enhance stability in one or more regions of a sole.

Referring to FIG. 16, article 1700 may include rib system 1790. In some cases, rib system 1790 can further include first rib member 1791 and second rib member 1792. In this embodiment, first rib member 1791 may be raised with respect to sole 1706. Likewise, second rib member 1792 may be raised with respect to sole 1706. With this arrangement, first rib member 1791 and second rib member 1792 can enhance stability of sole 1706.

In different embodiments, rib members may be associated with various portions of a sole. In some cases, rib members can be disposed on a forefoot portion of a sole. In other cases, rib members can be disposed on an arch portion of a sole. In still other cases, rib members can be disposed on a heel portion of a sole. In embodiments with flex groove sets on a forefoot portion and an arch portion of a sole, one or more rib members may be disposed on an intermediate portion of the sole disposed between the arch portion and the forefoot portion.

In this embodiment, rib system 1790 may be disposed on intermediate portion 1720 of sole 1706, which is disposed between forefoot portion 1703 and arch portion 1708. In particular, first rib member 1791 may extend from third flex groove 1763 to first sole pod 1793 in a substantially diagonal manner. Likewise, second rib member 1792 may extend from first flex groove 1761 to second sole pod 1794 in a substantially diagonal manner. With this arrangement, first rib member 1791 and second rib member 1792 may help enhance stability in intermediate portion 1720.

While various embodiments of the invention have been described, the description is intended to be exemplary, rather than limiting and it will be apparent to those of ordinary skill in the art that many more embodiments and implementations are possible that are within the scope of the invention. Accordingly, the invention is not to be restricted except in light of the attached claims and their equivalents. Also, various modifications and changes may be made within the scope of the attached claims.

We claim:

1. An article of footwear, comprising:

a sole including a central portion, a peripheral portion disposed outwards from the central portion, a heel portion, a forefoot portion having a toe portion, and an arch portion disposed between the heel portion and the forefoot portion, wherein the central portion and the peripheral portion each overlap with the forefoot portion;

a pivot portion disposed on the central portion, wherein the pivot portion is a round pad surrounded by a round groove;

a first flex groove set including a plurality of flex grooves extending in a radial direction from the pivot portion, the plurality of flex grooves being configured to facilitate bending of the central portion and the peripheral portion; and a second flex groove set including a plurality of flex grooves extending across the arch portion, the second flex groove set being configured to facilitate bending in the arch portion.

2. The article of footwear according to claim 1, wherein the first flex groove set includes a longitudinal flex groove having a first longitudinal flex groove portion extending from the pivot portion toward the heel portion along the central portion and wherein the second flex groove set includes a plurality of flex grooves extending diagonally from a lateral portion of the sole to a medial portion of the sole.

3. The article of footwear according to claim 2, wherein the pivot portion is a circular pad and a first flex groove of the second flex groove set intersects with a second flex groove of the second flex groove set.

4. The article of footwear according to claim 2, wherein a first flex groove of the second flex groove set is parallel with a second flex groove of the second flex groove set.

5. The article of footwear according to claim 4, wherein the second flex groove set includes a first flex groove having a depth that varies along the length of the first flex groove.

6. The article of footwear according to claim 5, wherein the second flex groove set includes a second flex groove having a substantially constant depth along the length of the second flex groove.

7. The article of footwear according to claim 1, further comprising:

a plurality of sole pods disposed on the bottom surface of the sole, wherein at least one sole pod of the plurality of sole pods is disposed over at least one peripheral flex groove and includes at least one pod flex groove, the at least one pod flex groove being aligned with at least one peripheral flex groove such that the at least one peripheral flex groove is exposed through the at least one pod flex groove.

8. The article of footwear according to claim 1, wherein the first flex groove set includes a longitudinal flex groove having:

a first longitudinal flex groove portion extending from the pivot portion toward the heel portion along the central portion and;

a second longitudinal flex groove portion extending from the pivot portion toward an edge of the toe portion and terminates before reaching the edge of the toe portion.

9. The article of footwear according to claim 1, further comprising:

a heel sole pod disposed on the heel portion.

10. The article of footwear according to claim 1, wherein the pivot portion is a circular pad.

11. An article of footwear, comprising:

a sole including a central portion, a peripheral portion disposed outwards from the central portion, a heel portion, a forefoot portion having a toe portion, and an arch portion disposed between the heel portion and the forefoot portion, wherein the central portion and the peripheral portion each overlap with the forefoot portion and the heel portion;

a pivot portion disposed on the central portion, wherein the pivot portion is a round pad surrounded by a round groove;

a first flex groove set including a plurality of flex grooves extending in a radial direction from the pivot portion, the plurality of flex grooves being configured to facilitate bending of the central portion and the peripheral portion; and a second flex groove set including a plurality of flex grooves extending across the arch portion, a first flex groove of the second flex groove set having a depth that varies along the length of the first flex groove.

12. The article of footwear according to claim 11, wherein the depth of the first flex groove is shallower in the central portion than in a peripheral portion.

13. The article of footwear according to claim 11, wherein the depth of the first flex groove decreases from the peripheral portion toward the central portion.

14. The article of footwear according to claim 11, wherein the depth of a second flex groove of the second flex groove set has a substantially constant depth along the length of the second flex groove.

15. An article of footwear, comprising:

a sole including a central portion, a peripheral portion disposed outwards from the central portion, a forefoot portion, a heel portion and an arch portion disposed between the forefoot portion and the heel portion wherein the central portion and the peripheral portion each overlap with the forefoot portion;

a pivot portion disposed on the central portion, wherein the pivot portion is a round pad surrounded by a round groove;

a first flex groove set, including a plurality of flex grooves disposed in the forefoot portion;

a second flex groove set, including a plurality of flex grooves disposed in the arch portion; and wherein the first flex groove set has a first average depth that is substantially less than a second average depth of the second flex groove set.

16. The article of footwear according to claim 15, wherein the first flex groove set includes a plurality of flex grooves extending in a substantially radial direction from the pivot portion of the forefoot portion.

17. The article of footwear according to claim 16, wherein the second flex groove set is configured to facilitate bending in a first bending direction associated with an upward bending of a toe portion of the sole and wherein the second flex groove set is configured to substantially reduce bending in a second bending direction associated with a downward bending of the toe portion.

18. The article of footwear according to claim 15, wherein the second flex groove set includes a plurality of flex grooves extending diagonally from a lateral portion of the sole to a medial portion of the sole.

19. The article of footwear according to claim 18, wherein a first flex groove of the second flex groove set intersects with a second flex groove of the second flex groove set.

20. The article of footwear according to claim 18, wherein a first flex groove of the second flex groove set is parallel with a second flex groove of the second flex groove set.

* * * * *